US011335249B1

(12) United States Patent
Ma et al.

(10) Patent No.: US 11,335,249 B1
(45) Date of Patent: May 17, 2022

(54) LIGHT-EMITTING PANEL AND BRIGHTNESS ADJUSTMENT METHOD, AND DISPLAY DEVICE

(71) Applicant: Xiamen Tianma Micro-Electronics Co., Ltd., Xiamen (CN)

(72) Inventors: Conghua Ma, Shanghai (CN); Xiaoping Sun, Shanghai (CN); Lihua Wang, Shanghai (CN); Qiang Dong, Shanghai (CN); Yue Yang, Shanghai (CN); Qiongqin Mao, Shanghai (CN); Juan Wu, Shanghai (CN); Jiayin Tang, Shanghai (CN)

(73) Assignee: Xiamen Tianma Micro-Electronics Co., Ltd., Xiamen (CN)

( * ) Notice: Subject to any disclaimer, the term of this patent is extended or adjusted under 35 U.S.C. 154(b) by 0 days.

(21) Appl. No.: 17/234,979

(22) Filed: Apr. 20, 2021

(30) Foreign Application Priority Data

Jan. 13, 2021 (CN) ..... 202110041177.6

(51) Int. Cl.
*G09G 3/32* (2016.01)

(52) U.S. Cl.
CPC ..... *G09G 3/32* (2013.01); *G09G 2310/027* (2013.01); *G09G 2320/0633* (2013.01)

(58) Field of Classification Search
CPC ..... G09G 3/32; G09G 2310/027; G09G 2320/0633
See application file for complete search history.

(56) References Cited

U.S. PATENT DOCUMENTS

2013/0321483 A1* 12/2013 You ..... G09G 3/2025 345/690
2019/0114971 A1* 4/2019 Choi ..... G09G 3/2014

FOREIGN PATENT DOCUMENTS

| | | | |
|---|---|---|---|
| CN | 1885377 | A | 12/2006 |
| CN | 102081908 | A | 6/2011 |
| CN | 103456257 | A | 12/2013 |
| CN | 105096824 | A | 11/2015 |
| CN | 111028810 | A | 4/2020 |

* cited by examiner

*Primary Examiner* — Andrew Sasinowski
(74) *Attorney, Agent, or Firm* — Anova Law Group, PLLC

(57) ABSTRACT

A light-emitting panel and a brightness adjustment method, and a display device are provided. The method includes providing the light-emitting panel including a substrate, a plurality of light-emitting units, a control circuit, and a plurality of signal lines. The control circuit includes a data signal input terminal, a data storage unit, and a plurality of first signal terminals. The data storage unit is configured to store a first voltage signal and a first pulse width modulation signal corresponding to a different grayscale value. Each signal line connects a light-emitting unit with a first signal terminal. The method also includes obtaining a to-be-displayed screen, and determining each grayscale value of a corresponding light-emitting unit of the plurality of light-emitting units. Further, the method includes according to different grayscale values, calling the first pulse width modulation signal and the first voltage signal corresponding to each grayscale value in the data storage unit.

20 Claims, 12 Drawing Sheets

LIGHT-EMITTING PANEL AND BRIGHTNESS ADJUSTMENT METHOD, AND DISPLAY DEVICE

CROSS-REFERENCE TO RELATED APPLICATION

This application claims the priority of Chinese patent application No. 202110041177.6, filed on Jan. 13, 2021, the entirety of which is incorporated herein by reference.

FIELD

The present disclosure generally relates to the field of display technology and, more particularly, relates to a light-emitting panel and a brightness adjustment method, and a display device.

BACKGROUND

With the advent of the ultra-high-definition display era, substantially high requirements for display image quality and resolution have been put forward. Light-emitting diode (LED) display has shown better performance than liquid-crystal display (LCD) and organic light-emitting diode (OLED) display. Therefore, mini/micro LED has become the most promising new display technology in the display field.

A mini/micro LED display device is often provided with a plurality of light-emitting elements and signal lines connected with the light-emitting elements, and the light-emitting element may receive a signal through the signal line to perform light-emitting display. The light-emitting element includes a transistor as a switch connected with each light-emitting element. A different pulse width modulation (PWM) signal may be outputted to the signal line to control the on-period of the transistor, to adjust the light-emitting brightness of each light-emitting element. However, the existing PWM dimming method is difficult to meet the high-resolution requirements, and even if a substantially high resolution can be achieved, the cost is substantially high.

Therefore, how to provide a light-emitting panel and a brightness adjustment method, and a display device that are capable of achieving fine dimming and meeting the requirements of high-resolution display is an urgent technical problem that needs to be solved.

SUMMARY

One aspect of the present disclosure provides a brightness adjustment method of a light-emitting panel. The brightness adjustment method includes providing the light-emitting panel. The light-emitting panel includes a substrate, a plurality of light-emitting units arranged in an array on the substrate, a control circuit, and a plurality of signal lines disposed on the substrate. The control circuit includes a data signal input terminal, a data storage unit, and a plurality of first signal terminals. The data storage unit is configured to store a first voltage signal and a first pulse width modulation signal corresponding to a different grayscale value. The data signal input terminal is electrically connected with the data storage unit, and the data storage unit is electrically connected with the plurality of first signal terminals. Each signal line connects a light-emitting unit of the plurality of light-emitting units with a first signal terminal of the plurality of first signal terminals. The brightness adjustment method also includes obtaining a to-be-displayed screen, and determining each grayscale value of a corresponding light-emitting unit of the plurality of light-emitting units in the to-be-displayed screen. Further, the brightness adjustment method includes according to different grayscale values, calling the first pulse width modulation signal and the first voltage signal corresponding to each grayscale value in the data storage unit.

Another aspect of the present disclosure provides a display panel. The display panel includes a substrate, a plurality of light-emitting units arranged in an array on the substrate, a control circuit, and a plurality of signal lines disposed on the substrate. The control circuit includes a data signal input terminal, a data storage unit, and a plurality of first signal terminals. The data storage unit is configured to store a first voltage signal and a first pulse width modulation signal corresponding to a different grayscale value. The data signal input terminal is electrically connected with the data storage unit, and the data storage unit is electrically connected with the plurality of first signal terminals. Each signal line connects a light-emitting unit of the plurality of light-emitting units with a first signal terminal of the plurality of first signal terminals. In a light-emitting stage, the data storage unit provides different first pulse width modulation signals and different first voltage signals to the first signal terminal. Each light-emitting unit includes a first grayscale value and a second grayscale value different from the first grayscale value. The first grayscale value corresponds to a first pulse signal outputted from the first signal terminal, and the second grayscale value corresponds to a second pulse signal outputted from the first signal terminal. The first pulse signal and the second pulse signal have different amplitudes, and/or the first pulse signal and the second pulse signal have different pulse widths.

Another aspect of the present disclosure provides a display device. The display device includes a display panel. The display panel includes a substrate, a plurality of light-emitting units arranged in an array on the substrate, a control circuit, and a plurality of signal lines disposed on the substrate. The control circuit includes a data signal input terminal, a data storage unit, and a plurality of first signal terminals. The data storage unit is configured to store a first voltage signal and a first pulse width modulation signal corresponding to a different grayscale value. The data signal input terminal is electrically connected with the data storage unit, and the data storage unit is electrically connected with the plurality of first signal terminals. Each signal line connects a light-emitting unit of the plurality of light-emitting units with a first signal terminal of the plurality of first signal terminals. In a light-emitting stage, the data storage unit provides different first pulse width modulation signals and different first voltage signals to the first signal terminal. Each light-emitting unit includes a first grayscale value and a second grayscale value different from the first grayscale value. The first grayscale value corresponds to a first pulse signal outputted from the first signal terminal, and the second grayscale value corresponds to a second pulse signal outputted from the first signal terminal. The first pulse signal and the second pulse signal have different amplitudes, and/or the first pulse signal and the second pulse signal have different pulse widths.

Other aspects of the present disclosure can be understood by those skilled in the art in light of the description, the claims, and the drawings of the present disclosure.

BRIEF DESCRIPTION OF THE DRAWINGS

To more clearly illustrate the embodiments of the present disclosure, the drawings will be briefly described below. The drawings in the following description are certain embodiments of the present disclosure, and other drawings may be obtained by a person of ordinary skill in the art in view of the drawings provided without creative efforts.

DETAILED DESCRIPTION OF THE DISCLOSURE

Reference will now be made in detail to exemplary embodiments of the disclosure, which are illustrated in the accompanying drawings. Wherever possible, the same reference numbers will be used throughout the drawings to refer to the same or the alike parts. The described embodiments are some but not all of the embodiments of the present disclosure. Based on the disclosed embodiments, persons of ordinary skill in the art may derive other embodiments consistent with the present disclosure, all of which are within the scope of the present disclosure.

Similar reference numbers and letters represent similar terms in the following Figures, such that once an item is defined in one Figure, it does not need to be further discussed in subsequent Figures.

Figure 1:
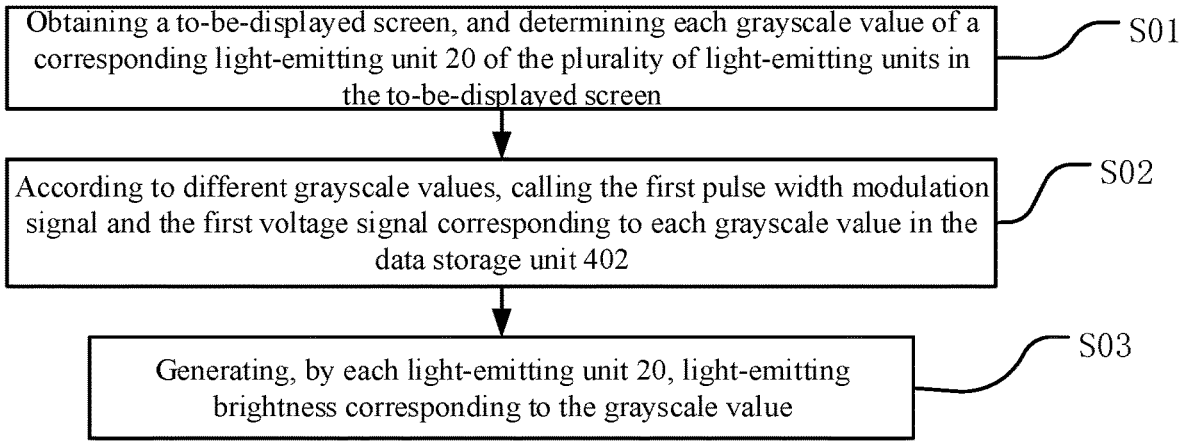
FIG. 1 illustrates a schematic flowchart of an exemplary brightness adjustment method of a light-emitting panel consistent with disclosed embodiments of the present disclosure.
Figure 2:
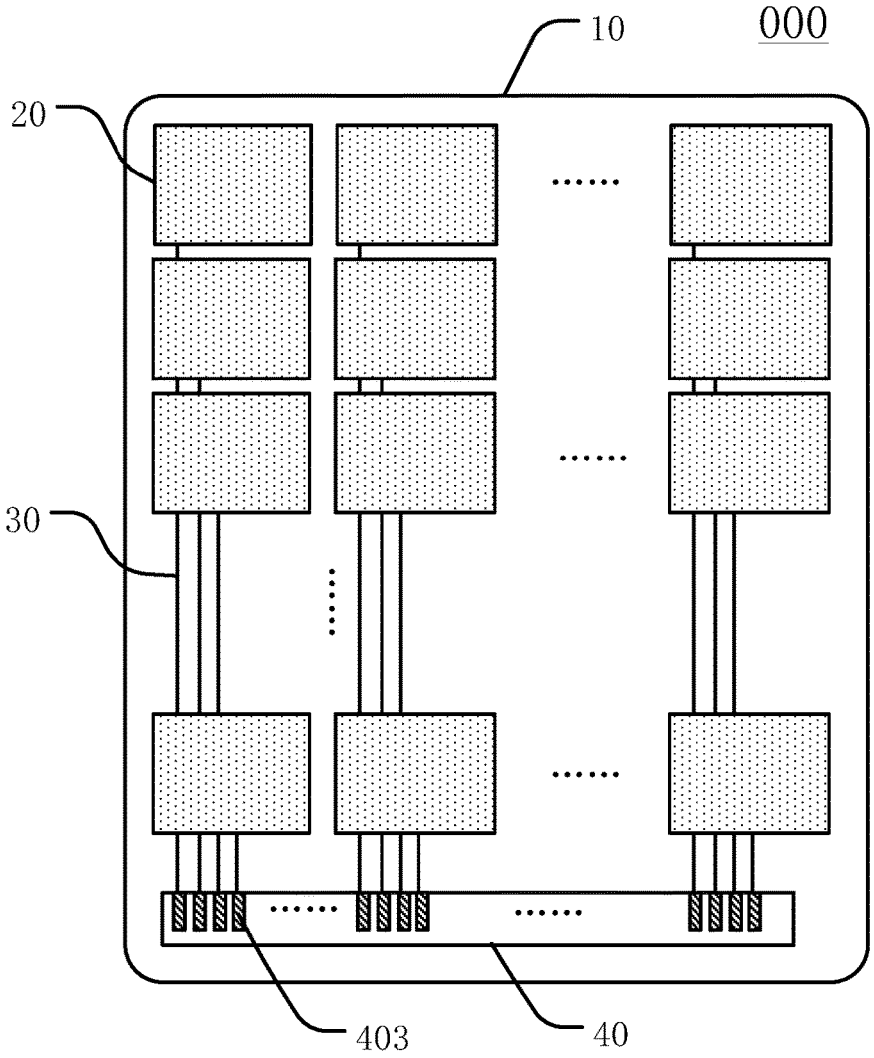
FIG. 2 illustrates a schematic top-view of an exemplary light-emitting panel using a brightness adjustment method in FIG. 1 to emit light consistent with disclosed embodiments of the present disclosure.

The present disclosure provides a brightness adjustment method of a light-emitting panel. FIG. 1 illustrates a schematic flowchart of a brightness adjustment method of a light-emitting panel consistent with disclosed embodiments of the present disclosure; FIG. 2 illustrates a schematic top-view of a light-emitting panel using the brightness adjustment method in FIG. 1 to emit light; and FIG. 3 illustrates a schematic diagram of a frame connection structure of a control circuit consistent with disclosed embodiments of the present disclosure.

Figure 3:
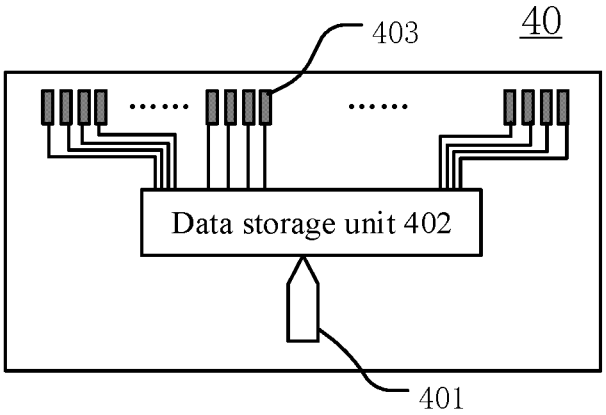
FIG. 3 illustrates a schematic diagram of a frame connection structure of a control circuit consistent with disclosed embodiments of the present disclosure.

Referring to FIGS. 1-3, the light-emitting panel 000 may include a substrate 10 and a plurality of light-emitting units 20 arranged in an array on the substrate 10. The light-emitting panel 000 may further include a control circuit 40 and a plurality of signal lines 30 disposed on the substrate 10. The control circuit 40 may include a data signal input terminal 401, a data storage unit 402, and a plurality of first signal terminals 403. The data storage unit 402 may be configured to store a first voltage signal and a first pulse width modulation signal corresponding to a different grayscale value.

The data signal input terminal 401 may be electrically connected with the data storage unit 402, the data storage unit 402 may be electrically connected with the plurality of first signal terminals 403, and each signal line 30 may connect a light-emitting unit 20 with a first signal terminal 403.

The brightness adjustment method may include following.

In S01: obtaining a to-be-displayed screen, and determining each grayscale value of a corresponding light-emitting unit 20 of the plurality of light-emitting units in the to-be-displayed screen.

In S02: according to different grayscale values, calling the first pulse width modulation signal and the first voltage signal corresponding to each grayscale value in the data storage unit 402.

In S03: generating, by each light-emitting unit 20, light-emitting brightness corresponding to the grayscale value.

Specifically, according to the brightness adjustment method of the light-emitting panel in the disclosed embodiments, the light-emitting panel 000 adopting such brightness adjustment method may include the substrate 10. The substrate 10 may serve as a carrier to carry related structures for fabricating the light-emitting panel 000. The light-emitting panel 000 may also include the plurality of light-emitting units 20 arranged in an array on the substrate 10. Moreover, the light-emitting panel 000 may include the control circuit 40 and the plurality of signal lines 30 disposed on the substrate 10. The control circuit 40 may include the data signal input terminal 401, the data storage unit 402, and the plurality of first signal terminals 403.

The data signal input terminal 401 may be electrically connected with the data storage unit 402. The data signal input terminal 401 may be configured to provide an external control signal source to the data storage unit 402, to control the data call and data output of the data storage unit 402. The data storage unit 402 may be electrically connected with the plurality of first signal terminals 403, and each signal line 30 may connect a light-emitting unit 20 with a first signal terminal 403. The data storage unit 402 may be configured to store a first voltage signal and a first pulse width modulation signal corresponding to a different grayscale value. According to the different grayscale value corresponding to the different light-emitting unit 20 in the to-be-displayed screen, the pulse width modulation signal and the first voltage signal corresponding to each grayscale value in the data storage unit 402 may be called. Under the control of the external control signal source of the data signal input terminal 401, the pulse width modulation signal and the first voltage signal corresponding to each grayscale value may be transmitted to each light-emitting unit 20 through the signal lines 30 and the plurality of first signal terminals 403 of the control circuit 40, to make each light-emitting unit 20 generate light-emitting brightness corresponding to the above-mentioned grayscale value, thereby achieving the display of the to-be-displayed screen.

In one embodiment, each signal line 30 may connect a light-emitting unit 20 with a first signal terminal 403. Optionally, each light-emitting unit 20 may be connected to at least one signal line 30, and the signal transmission between the light-emitting unit 20 and the first signal terminal 403 of the control circuit 40 may be achieved through the at least one signal line 30. Optionally, each light-emitting unit 20 may be connected to two or three signal lines 30, and the signal transmission between the light-emitting unit 20 and the first signal terminal 403 of the control circuit 40 may be achieved through multiple signal lines 30, which may facilitate to reduce the impedance of the transmission signal. The control circuit 40 may be integrated into any one of a driving chip, a flexible circuit board and a printed circuit board, and may be configured to provide the data signal input terminal 401 and the plurality of first signal terminals 403. At the same time, the data storage unit 402 may be integrated to provide a driving signal of achieving the light-emitting function for each light-emitting unit 20.

The brightness adjustment method in the present disclosure may drive the above-mentioned light-emitting panel 000. The brightness adjustment method may include under the control of the external control signal source of the data signal input terminal 401, obtaining the to-be-displayed screen of the light-emitting panel 000 and determining each grayscale value of a corresponding light-emitting unit 20 of the plurality of light-emitting units in the to-be-displayed screen. The brightness adjustment method may also include according to the different grayscale value, calling the first pulse width modulation signal and the first voltage signal corresponding to each grayscale value in the data storage unit 402. Optionally, parameters of the first pulse width modulation signal and the first voltage signal corresponding to each grayscale value may be pre-stored in the data storage unit 402, and may be directly called by the light-emitting panel 000 during the brightness adjustment process. The brightness adjustment method may also include transmitting the first pulse width modulation signal and the first voltage signal corresponding to the different grayscale value of each light-emitting unit 20 and called from the data storage unit 402 to each light-emitting unit through the first signal terminals 403, to make each light-emitting unit 20 generate light-emitting brightness corresponding to the grayscale value to achieve the display of the to-be-displayed screen.

In one embodiment, the first pulse width modulation signal may be configured to control the on-period of the light-emitting unit 20, and the first voltage signal may be configured to control a conduction current of the light-emitting unit 20. The first pulse width modulation signal and the first voltage signal corresponding to a different grayscale value may be transmitted to a same light-emitting unit 20 through a same first signal terminal 403, to synchronously control the on-period and conduction current of the light-emitting unit 20.

Figure 4:
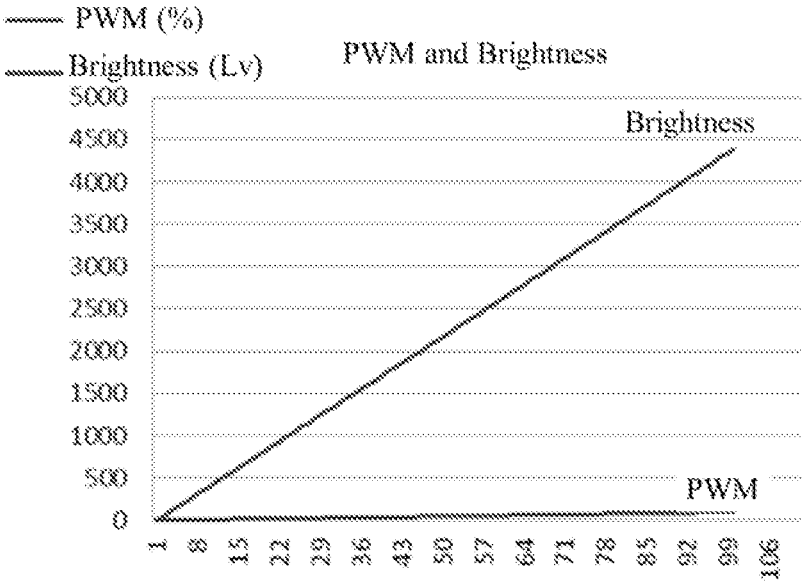
FIG. 4 illustrates a diagram of a relationship between a pulse width modulation signal and light-emitting brightness.

The existing dimming method may merely use the pulse width modulation (PWM) signal, where the pulse width may be adjusted to control different light-emitting brightness of the light-emitting unit (the greater the pulse width, the greater the light-emitting brightness). FIG. 4 illustrates a diagram of a relationship between a pulse width modulation signal and light-emitting brightness. Referring to FIG. 4, the light-emitting brightness of the light-emitting element has an exponential relationship with the current. The method of controlling different light-emitting brightness of the light-emitting element by adjusting the pulse width as shown in FIG. 4 does not simply adopt equal-spaced duty cycle modulation. The current change rate is negatively correlated with the duty cycle modulation amplitude of the PWM signal. In other words, the greater the current change rate, the smaller the increase in the duty cycle of the PWM signal between different levels. Therefore, when the duty cycle of the PWM signal is adjusted in a small range, the current changes greatly, and the brightness changes greatly, which easily causes uneven brightness change gradient. Therefore, the brightness interval is divided to obtain the correspondence relationship between the different grayscale value and brightness. Further, because the grayscale change gradient is uneven, it is difficult to achieve a smooth transition of multiple grayscale adjustment, and it is substantially difficult to achieve fine grayscale adjustment.

In addition, the existing PWM dimming method adopts a voltage-driving method, while the commercially available PWM dimming driving chip (LED drive) is a current-type driving chip. The current-type driving chip generates a substantially large heat during operation. If the current-type driving chip is directly bonded on the light-emitting panel, it is difficult to dissipate heat. Therefore, the current-type driving chip is often packaged, and the packaged current-type driving chip may merely be mounted on a printed circuit board (PCB), and then the bonding electrical connection between the PCB board and the signal line on the light-emitting panel is achieved by a flexible printed circuit (FPC). Therefore, the commercially available current-type driving chip for PWM dimming may not be directly bonded on the light-emitting panel in the manner of chip on glass (COG, where the chip is directly bonded on the substrate of the light-emitting panel).

Moreover, the current-type driving chip for PWM dimming may need to be equipped with field-programmable gate array (FPGA) to convert the current-driving signal into a PWM-driving signal. The circuit structure is complicated, and the FPGA circuit unit occupies a substantially large space and may not be bonded on the substrate. Therefore, a large PCB board needs to be made, and the current-type driving chip for PWM dimming may be bridged to the light-emitting panel through the FPC.

In addition, if the fine dimming is achieved by directly using PWM dimming method, each signal line on the light-emitting panel may need to be provided with a different PWM driving signal. In other words, the more the brightness interval levels, the greater the quantity of achievable grayscale levels. For example, in a 4K-LED display screen, more than 4096 PWM driving signals need to be provided to realize the display. Further, based on the relationship curve between the PWM signal and the brightness, algorithm control is also required, and the chip operation is complicated. Thus, it is necessary to customize the development and processing of the voltage-type driving chip for PWM dimming, and the cost is substantially high.

In the brightness adjustment method in the present disclosure, the first pulse width modulation signal and the first voltage signal may together act on the on-period and the conduction current of the light-emitting unit 20 at the same time. Based on the interaction effects of the on-period and the conduction current, compared with the existing method of using the pulse width modulation signal, more kinds of brightness gradient may be generated. According to the correspondence relationship between different brightness and the first pulse width modulation signal as well as the first voltage signal, the brightness interval may be divided to obtain the correspondence relationship between the different grayscale value and the first pulse width modulation signal as well as the first voltage signal. Therefore, different light-emitting unit 20 may generate corresponding light-emitting brightness according to the requirements of different grayscale value, and, thus, may provide more kinds of different grayscale brightness to achieve substantially fine dimming. When the light-emitting panel 000 is used as a backlight or a display, the requirements of high-resolution backlight or display may be satisfied, which may improve the display quality.

It should be noted that the light-emitting panel 000 in the disclosed embodiments may be used as a direct backlight including a surface light source, and may also be used as a display panel, which may improve the display resolution through fine dimming to meet the requirements of high-quality display. It should be understood that FIG. 3 merely illustrates the control circuit 40 using a frame structure. In specific implementation, the structure of the control circuit 40 may not be limited to such structure, and may be integrated with any other driving unit, which may not be limited by the present disclosure, as long as the control circuit is capable of providing a driving signal for the light-emitting unit 20 to achieve fine dimming.

It should be understood that the light-emitting panel 000 in the disclosed embodiments may include a control circuit 40. The control circuit 40 may be integrated in a driving chip, a flexible circuit board, or a printed circuit board. The data storage unit may be separately integrated in the driving chip, a flexible circuit board, or a functional unit in the printed circuit board, may be configured to achieve store and call of the corresponding light-emitting grayscale data signal, and may be bonded and connected to the substrate 10 of the light-emitting panel 000 through the flexible circuit board. In addition, in the present disclosure, a voltage-type driving chip may be directly used for the integrated design of the control circuit without converting a current-type driving chip to a voltage-type driving PWM signal through FPGA. Therefore, the control circuit may be directly bonded and connected to the substrate 10 of the light-emitting panel 000 through COG. While achieving fine dimming, the control circuit may have a simple connection structure, may be easily integrated, and may have a substantially low manufacturing cost.

Figure 5:
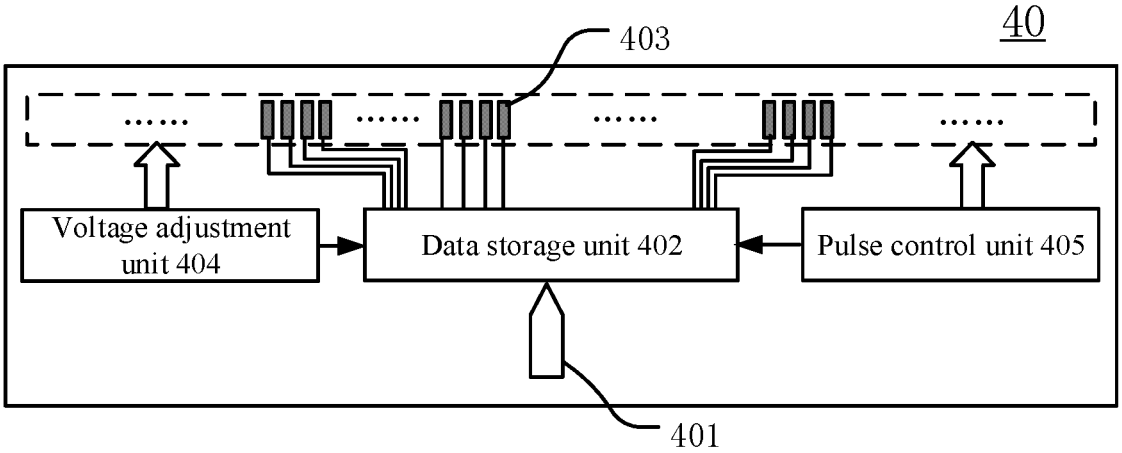
FIG. 5 illustrates a schematic diagram of a frame connection structure of another control circuit consistent with disclosed embodiments of the present disclosure.
Figure 6:
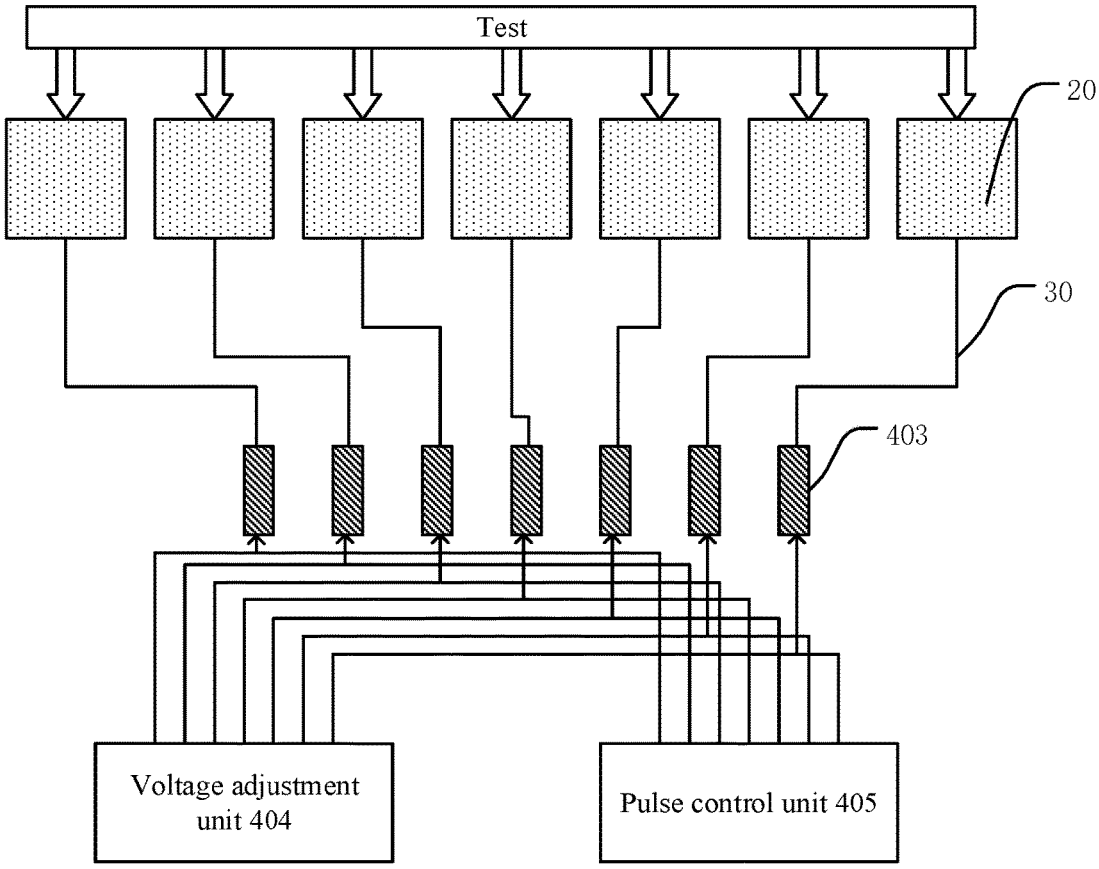
FIG. 6 illustrates a block diagram of a pre-storage operating principle of a data storage unit in a control circuit consistent with disclosed embodiments of the present disclosure.
Figure 7:
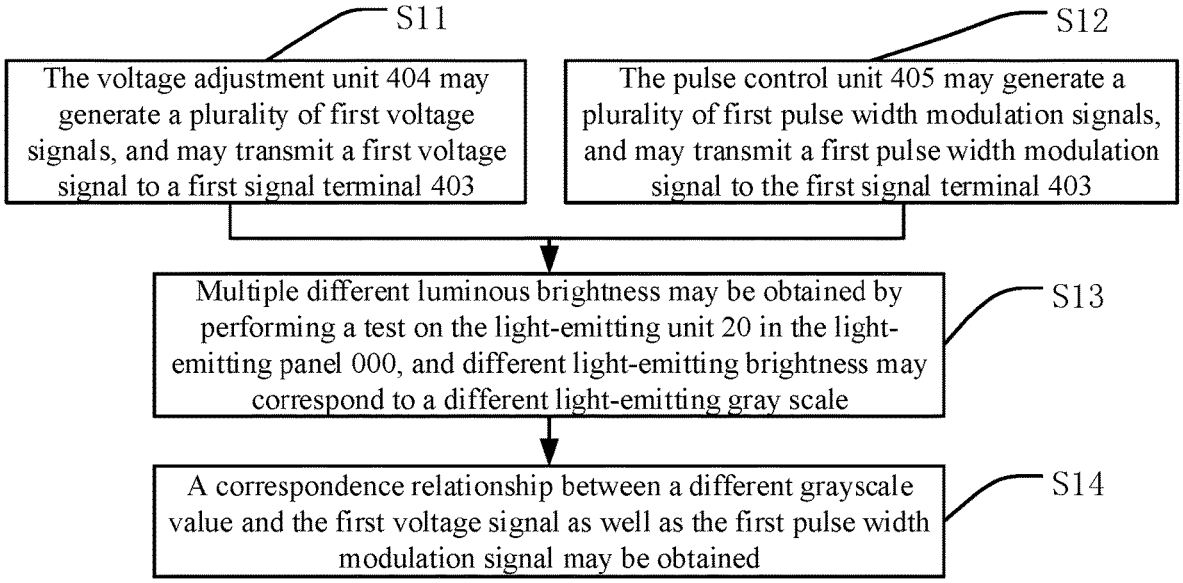
FIG. 7 illustrates a schematic pre-storage flowchart of a data storage unit consistent with disclosed embodiments of the present disclosure.

FIG. 5 illustrates a schematic diagram of a frame connection structure of another control circuit consistent with disclosed embodiments of the present disclosure; FIG. 6 illustrates a block diagram of a pre-storage operating principle of a data storage unit in a control circuit consistent with disclosed embodiments of the present disclosure; and FIG. 7 illustrates a schematic pre-storage flowchart of a data storage unit consistent with disclosed embodiments of the present disclosure. In certain embodiments, referring to FIGS. 1-2 and FIGS. 5-7, the control circuit 40 may further include a voltage adjustment unit 404 and a pulse control unit 405.

In S11: the voltage adjustment unit 404 may generate a plurality of first voltage signals, and may transmit a first voltage signal to a first signal terminal 403.

In S12: the pulse control unit 405 may generate a plurality of first pulse width modulation signals, and may transmit a first pulse width modulation signal to the first signal terminal 403. S11 and S12 may be simultaneously performed. Each signal line 30 may connect one light-emitting unit 20 with one first signal terminal 403. Therefore, a brightness test may be performed on each light-emitting unit 20 in the light-emitting panel 000 through each signal line 30.

In S13: multiple different light-emitting brightness may be obtained, and different light-emitting brightness may correspond to a different light-emitting gray scale.

The process of obtaining the different light-emitting gray scale through different light-emitting brightness may include dividing the brightness change between the brightest and the darkest obtained in the brightness test into several parts, to facilitate the control of the light-emitting brightness corresponding to the inputted first voltage signal and the pulse width modulation signal. For illustrative purposes, a display panel with 8-bit may be used as an example. The display panel may have 256 ($2^8$) brightness levels, and the light-emitting grayscale may be divided into 256 gray scales. Because each digital image to be presented by the display panel may be composed of many dots, and such dots may also be referred to pixels. Each pixel may often present many different colors, and, thus, each pixel may be composed of red, green, and blue three sub-pixels. A light source behind each sub-pixel may show different brightness levels, and the gray scale may represent the level of different brightness from the darkest to the brightest. The more the levels, the more delicate the presented screen effect. For example, the display panel with 8-bit may show 256 ($2^8$) brightness levels, i.e., 256 gray scales. Each pixel of the display panel may be composed of red, green, and blue sub-pixels with different brightness levels to form a different color dot. In other words, the color change of each pixel of the display panel may be determined by the grayscale change of the red, green and blue three sub-pixels that are composed of such pixel.

In S14: after finishing the brightness test on the light-emitting unit 20 of the light-emitting panel 000, the correspondence relationship between a different grayscale value and the first voltage signal as well as the first pulse width modulation signal may be obtained.

The disclosed embodiments may explain the process of pre-storing parameters in the data storage unit 402 of the control circuit 40. The control circuit 40 may further include the voltage adjustment unit 404 and the pulse control unit 405. Optionally, the voltage adjustment unit 404 and the pulse control unit 405 may be connected to the plurality of first signal terminals 403. When pre-storing the parameters, the voltage adjustment unit 404 may generate a plurality of first voltage signals, and may transmit the first voltage signals to a first signal terminal 403. At the same time, the pulse control unit 405 may generate a plurality of first pulse width modulation signals, and may transmit the first pulse width modulation signals to the first signal terminal 403. The first signal terminal 403 may synchronously transmit the first voltage signals and the first pulse width modulation signals to a same light-emitting unit 20 through the signal line 30. A brightness test may be performed on each light-emitting unit 20 to obtain a plurality of different light-emitting brightness. Then, according to the different light-emitting brightness, different light-emitting gray scale may be correspondingly obtained. In other words, the brightness change between the brightest and the darkest obtained in the brightness test may be divided into several parts, to facilitate the control of the light-emitting brightness corresponding to the inputted first voltage signal and pulse width modulation signal.

For illustrative purposes, a display panel with 8-bit may be used as an example. The display panel may have 256 ($2^8$) brightness levels, and the light-emitting grayscale may be divided into 256 gray scales. After dividing the brightness interval, a different light-emitting grayscale value corresponding to different light-emitting brightness may be obtained, such that the first pulse width modulation signal and the first voltage signal corresponding to each different grayscale value may be obtained. In other words, after finishing the brightness test on the light-emitting unit 20 of the light-emitting panel 000, the correspondence relationship between the different grayscale value and the first voltage signal as well as the first pulse width modulation signal may be obtained.

Figure 8:
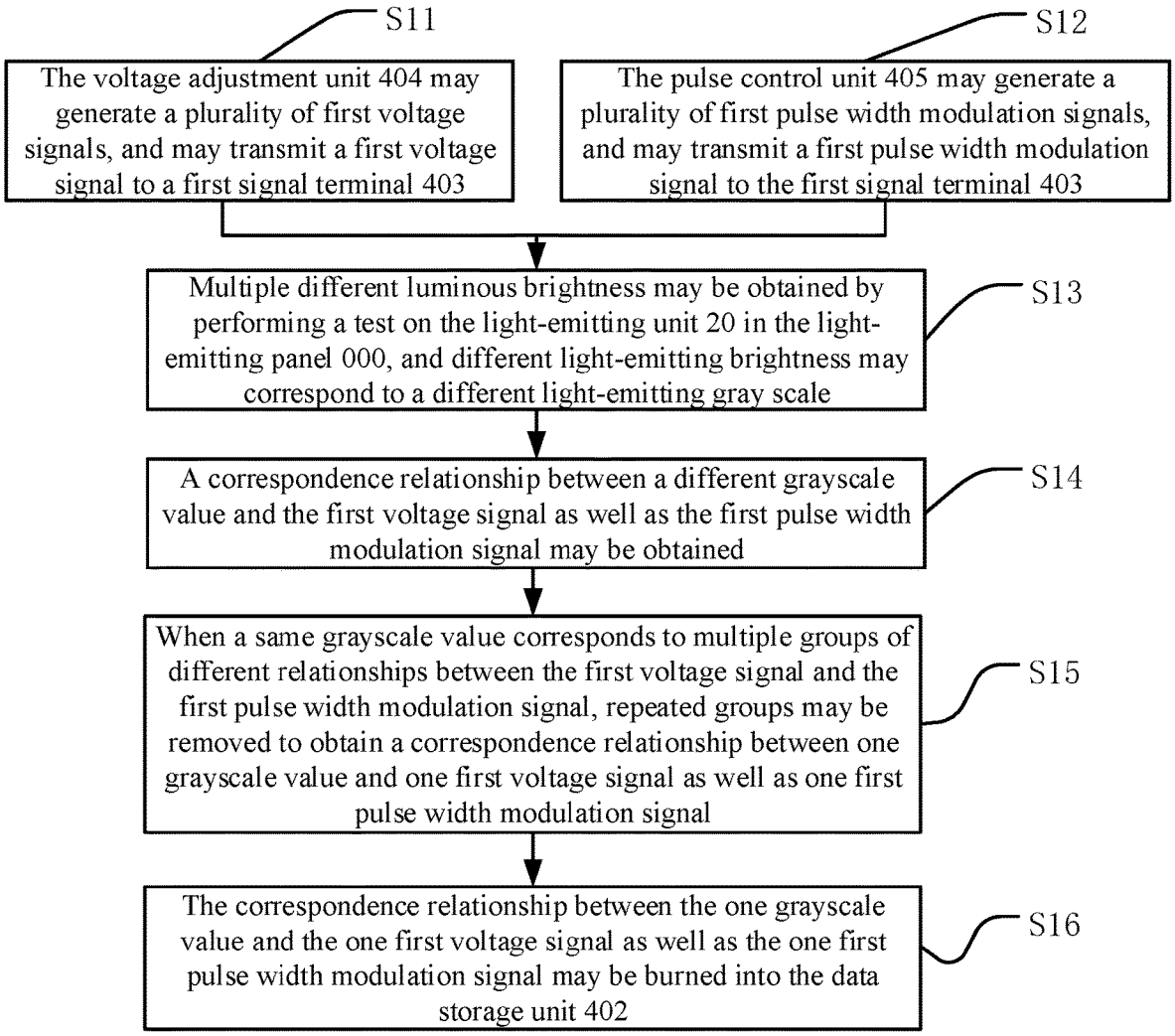
FIG. 8 illustrates a schematic pre-storage flowchart of another data storage unit consistent with disclosed embodiments of the present disclosure.

FIG. 8 illustrates a schematic pre-storage flowchart of another data storage unit consistent with disclosed embodiments of the present disclosure. In one embodiment, referring to FIGS. 1-2, FIGS. 5-6 and FIG. 8, after finishing the brightness test on the light-emitting unit 20 of the light-emitting panel 000 and obtaining the correspondence relationship between the different grayscale value and the first voltage signal as well as the first pulse width modulation signal, the method may further include following.

In S15: when a same grayscale value corresponds to multiple groups of different relationships between the first voltage signal and the first pulse width modulation signal, repeated groups may be removed to obtain a correspondence relationship between one grayscale value and one first voltage signal as well as one first pulse width modulation signal.

In S16: the correspondence relationship between the one grayscale value and the one first voltage signal as well as the one first pulse width modulation signal may be burned into the data storage unit 402.

The disclosed embodiments may explain the process of pre-storing parameters in the data storage unit 402 of the control circuit 40. The control circuit 40 may further include the voltage adjustment unit 404 and the pulse control unit 405. Optionally, each of the voltage adjustment unit 404 and the pulse control unit 405 may be connected with a plurality of first signal terminals 403. When pre-storing the parameters, the voltage adjustment unit 404 may generate a plurality of first voltage signals, and may transmit the first voltage signals to the first signal terminal 403. At the same time, the pulse control unit 405 may generate a plurality of first pulse width modulation signals, and may transmit the pulse width modulation signals to the first signal terminal 403. The first signal terminal 403 may synchronously transmit the first voltage signals and the first pulse width modulation signals to a same light-emitting unit 20 through the signal line 30.

Based on the interaction of the first voltage signal and the first pulse width modulation signal, compared with the PWM dimming mode, more kinds of brightness gradient changes may be generated. The brightness test may be performed on each light-emitting unit 20 of the light-emitting panel 000 through a brightness test device, to obtain multiple different light-emitting brightness. According to the correspondence relationship between the different brightness and the first pulse width modulation signal as well as the first voltage signal, the brightness interval may be divided to obtain the correspondence relationship between the different grayscale value and the first pulse width modulation signal as well as the first voltage signal. Therefore, different light-emitting unit 20 may produce the corresponding light-emitting brightness based on the demand for different grayscale value. In other words, the correspondence relationship between the different grayscale value and the first voltage signal as well as the first pulse width modulation signal may be obtained.

In view of this, a same grayscale value may correspond to multiple different groups of the first voltage signal and the first pulse width modulation signal. Then, merely the correspondence relationship between one grayscale value and one first voltage signal as well as one first pulse width modulation signal may be retained, while the other groups among the multiple different groups of the first voltage signal and the first pulse width modulation signal corresponding to the same grayscale value may be deleted, which may avoid causing data disorder when the light-emitting panel 000 calls the parameters of the data storage unit 402 during the light-emitting brightness adjustment process. Ultimately, the correspondence relationship between the one grayscale value and the one first voltage signal as well as the one first pulse width modulation signal may be burned into the data storage unit 402 of the control circuit 40. The light-emitting panel 000 may directly call the parameters of the first pulse width modulation signal and the first voltage signal corresponding to each grayscale value pre-stored in the data storage unit 402 during the brightness adjustment process, and may transmit the parameters to each light-emitting unit through the first signal terminal 403. Each light-emitting unit 20 may generate light-emitting brightness corresponding to the grayscale value, to achieve the display of the displayed screen.

Figure 9:
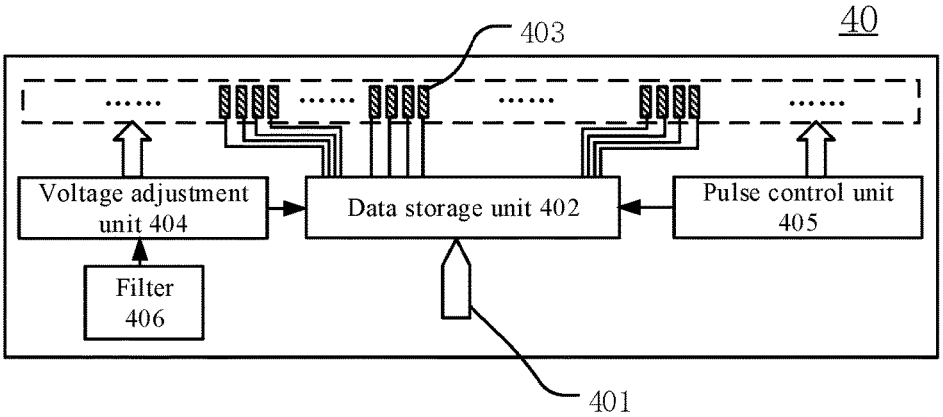
FIG. 9 illustrates a schematic diagram of a frame connection structure of another control circuit consistent with disclosed embodiments of the present disclosure.
Figure 10:
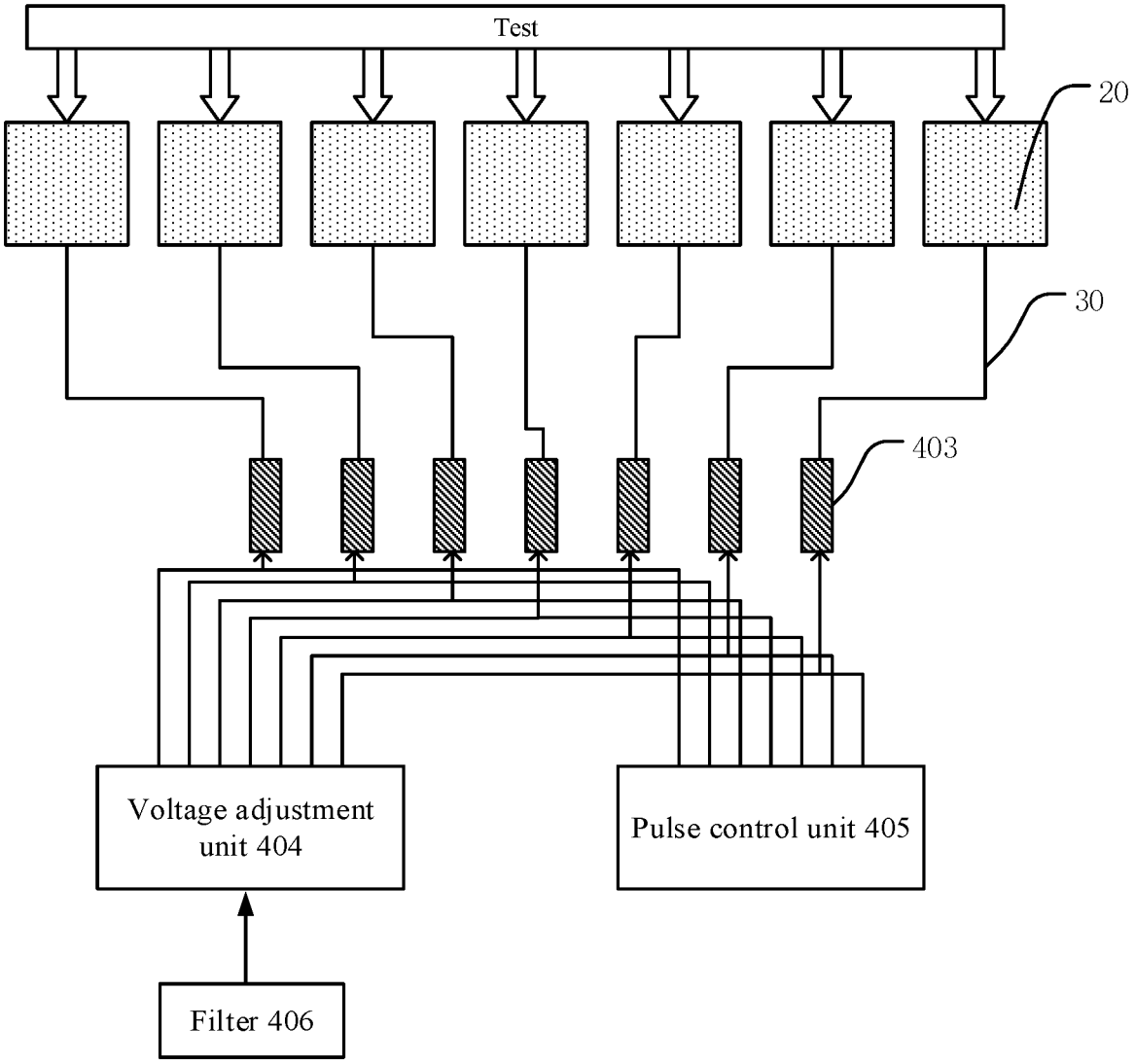
FIG. 10 illustrates a block diagram of a pre-storage operating principle of a data storage unit in another control circuit consistent with disclosed embodiments of the present disclosure.
Figure 11:
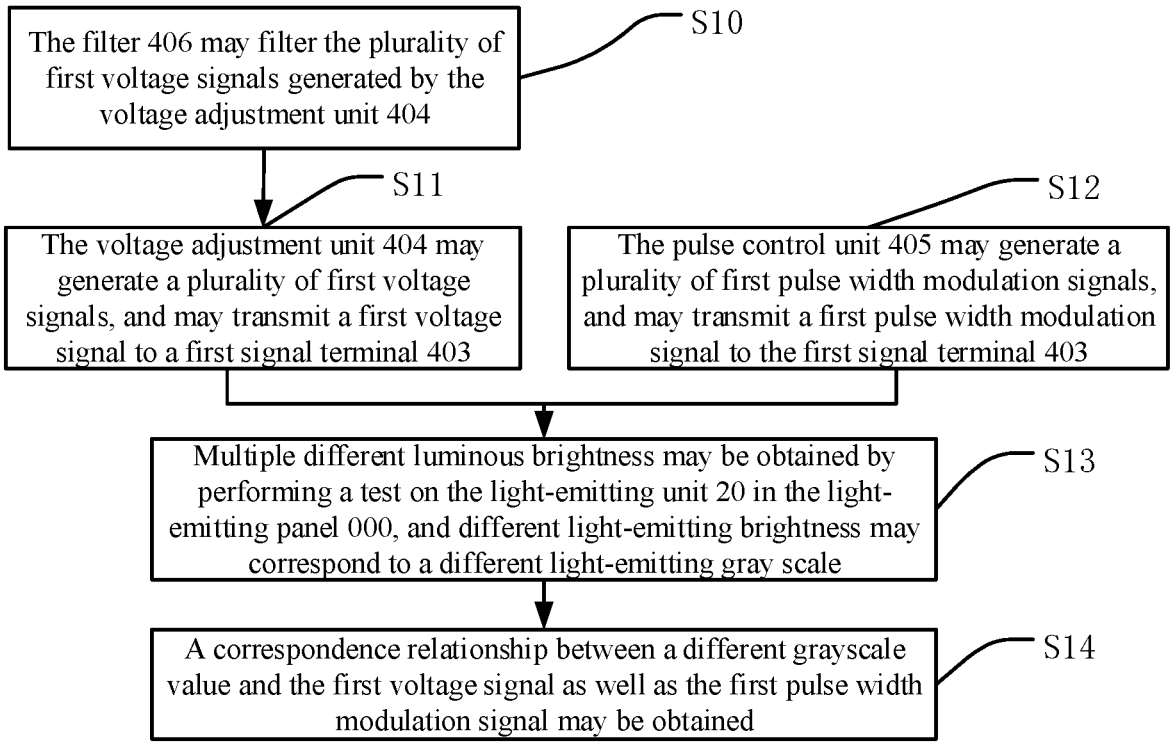
FIG. 11 illustrates a schematic pre-storage flowchart of another data storage unit consistent with disclosed embodiments of the present disclosure.

FIG. 9 illustrates a schematic diagram of a frame connection structure of another control circuit consistent with disclosed embodiments of the present disclosure; FIG. 10 illustrates a block diagram of a pre-storage operating principle of a data storage unit in a control circuit consistent with disclosed embodiments of the present disclosure; and FIG. 11 illustrates a schematic pre-storage flowchart of another data storage unit consistent with disclosed embodiments of the present disclosure. In one embodiment, referring to FIGS. 1-2 and FIGS. 9-11, the control circuit 40 may further include a filter 406. The filter 406 may be electrically connected with the voltage adjustment unit 404, and may be configured to transmit a first voltage signal greater than a preset voltage among the plurality of first voltage signals generated by the voltage adjustment unit 404 to the first signal terminal 403.

Optionally, the voltage adjustment unit 404 may generate a plurality of first voltage signals, and before transmitting the plurality of the first voltage signals to the first signal terminal 403, the method may further include following.

In S10: the filter 406 may filter the plurality of first voltage signals generated by the voltage adjustment unit 404, and the voltage signal greater than the preset voltage may be transmitted from the voltage adjustment unit 404 to the first signal terminal 403, such that the magnitudes of the plurality of first voltage signals generated by the voltage adjustment unit 404 may meet the requirements for driving the light-emitting unit 20 to emit light. The preset voltage may be a threshold voltage value that is capable of driving the light-emitting unit 20 to emit light. If the light-emitting unit 20 includes a light-emitting element, and the light-emitting element is connected with a control transistor, a threshold voltage value of the control transistor (a turned-on voltage of the control transistor in a critical turned-on state) may be the preset voltage in the present disclosure.

Further, the filter 406 may be electrically connected to the voltage adjustment unit 404, and the filter 406 may be integrated into the voltage adjustment unit 404 to form an entity, to enable the first voltage signals generated by the voltage adjustment unit 404 to be greater than the preset voltage. In another embodiment, the filter 406 may be connected between the voltage adjustment unit 404 and the first signal terminal 403. After the voltage adjustment unit 404 generates the plurality of first voltage signals, the filter 406 may remove the first voltage signal that is less than or equal to the preset voltage, and may merely transmit the first voltage signal greater than the preset voltage to the first signal terminal 403 (not illustrated). In certain embodiments, the filter 406 may directly act on the voltage adjustment unit 404 to make merely the first voltage signal greater than the preset voltage among the first voltage signals generated by the voltage adjustment unit 404 be capable of being transmitted from the voltage adjustment unit 404 to the first signal terminal, which may be set according to practical applications.

The disclosed embodiments may explain the process of pre-storing parameters in the data storage unit 402 of the control circuit 40. The voltage adjustment unit 404 may generate a plurality of first voltage signals, and before transmitting the first voltage signals to the first signal terminal 403, the plurality of first voltage signals generated by the voltage adjustment unit 404 may need to be capable of driving the light-emitting unit 20 to emit light. Therefore, the control circuit 40 in the disclosed embodiments may further include the filter 406. The filter 406 may be electrically connected to the voltage adjustment unit 404. The filter 406 may filter the plurality of first voltage signals generated by the voltage adjustment unit 404, and merely the voltage signal greater than the preset voltage may be sent from the voltage adjustment unit 404 to the first signal terminal 403. In other words, the signals generated by the voltage adjustment unit 404 and capable of being transmitted to the first signal terminal 403 may be the plurality of first voltage signals that satisfy the light-emitting driving condition. The plurality of first signal voltage signals may be transmitted to the first signal terminal 403 to drive the light-emitting unit 20 to emit light. The preset voltage may be a threshold voltage value capable of driving the light-emitting unit 20 to emit light.

If the light-emitting unit 20 includes a light-emitting element, and the light-emitting element is connected with a control transistor, a threshold voltage value of the control transistor (a turned-on voltage of the control transistor in a critical turned-on state) may be the preset voltage in the present disclosure.

At the same time, the pulse control unit 405 may generate a plurality of first pulse width modulation signals, and may transmit the first pulse width modulation signals to the first signal terminal 403. The first signal terminal 403 may synchronously transmit the first voltage signal and the first pulse width modulation signal to a same light-emitting unit 20 through the signal line 30. The brightness test may be performed on each light-emitting unit 20 of the light-emitting panel 000 through a brightness test device, to obtain multiple different light-emitting brightness. According to the correspondence relationship between the different brightness and the first pulse width modulation signal as well as the first voltage signal, the brightness interval may be divided to obtain the correspondence relationship between the different grayscale value and the first pulse width modulation signal as well as the first voltage signal. Therefore, different light-emitting unit 20 may produce the corresponding light-emitting brightness based on the demand for different grayscale value. At the same time, the first voltage signal that is not used and does not meet the preset voltage value may be eliminated through the filter step, which may facilitate to reduce the computational workload of the control circuit 40, thereby reducing the power consumption.

In certain embodiments, referring to FIGS. 1-11, the control circuit 40 may be integrated into a first chip. The first chip may be configured to generate the first voltage signal according to the relationship between the gray scale and the voltage, and the first voltage signal may be a pulse signal. The first chip may also be configured to generate the first pulse width modulation signal according to the relationship between gray scale and pulse width. Optionally, the voltage adjustment unit 404 and the pulse control unit 405, etc., included in the control circuit 40 may be integrated in the first chip.

The disclosed embodiments may explain that the voltage adjustment unit 404 for generating the plurality of first voltage signals and the pulse control unit 405 for generating the plurality of first pulse width modulation signals may be integrated in the first chip. The first chip may directly use a source driving chip (a chip integrated with a control circuit connected to each pixel unit through a data line) in the liquid-crystal display device. The source driving chip may include thousands of driving pins (referring to the first signal terminals 403 in the present disclosure). One first signal terminal 403 may correspond to one light-emitting unit 20. Taking the advantage of the source driving chip having thousands of driving pins as the first signal terminals 403, the partition control and separate lighting demands of the large number of light-emitting units 20 may be satisfied, and there is no need to develop a new driving chip for fine dimming of the light-emitting panel 000, which may save costs.

Because the source driving chip in the liquid-crystal display device meets the requirements of liquid-crystal deflection, the outputted voltage signal may have a polarity reversal. According to the relationship between gray scale and voltage (gamma curve function relationship with polarity reversal at the same time), the pulse control unit 405 integrated in the first chip may not only change the amplitude of the first voltage signal generated by the first chip, but also adjust the pulse width of the generated pulse signal.

By synchronously controlling the on-period and the conduction current of the light-emitting unit 20, based on the interaction effects of the on-period and the conduction current, compared with the PWM dimming method, more kinds of brightness gradient changes may be generated. According to the correspondence relationship between different brightness and the first pulse width modulation signal as well as the first voltage signal, the brightness interval may be divided, to obtain the correspondence relationship between the different grayscale value and the first pulse width modulation signal as well as the first voltage signal. Therefore, different light-emitting unit 20 may generate corresponding light-emitting brightness according to the requirements of different grayscale value, and, thus, may achieve substantially fine dimming to provide more kinds of different gray-scale brightness.

It should be understood that the first chip may directly adopt the source driving chip in the liquid-crystal display device. The source driving chip may be a voltage-type driving chip, and may not need to be packaged and then bound to the light-emitting panel through the PCB board, without a heat dissipation problem and without using FPGA to convert a current driving signal into a voltage driving signal. The first chip integrated with the control circuit 40 may be directly bound to the light-emitting panel 000 in a COG manner, which may not only have a simple manufacturing process and achieve the high integration with the light-emitting panel 000, but also achieve a large number of brightness levels and a large number of different gray scales, thereby achieving substantially fine dimming.

Figure 12:
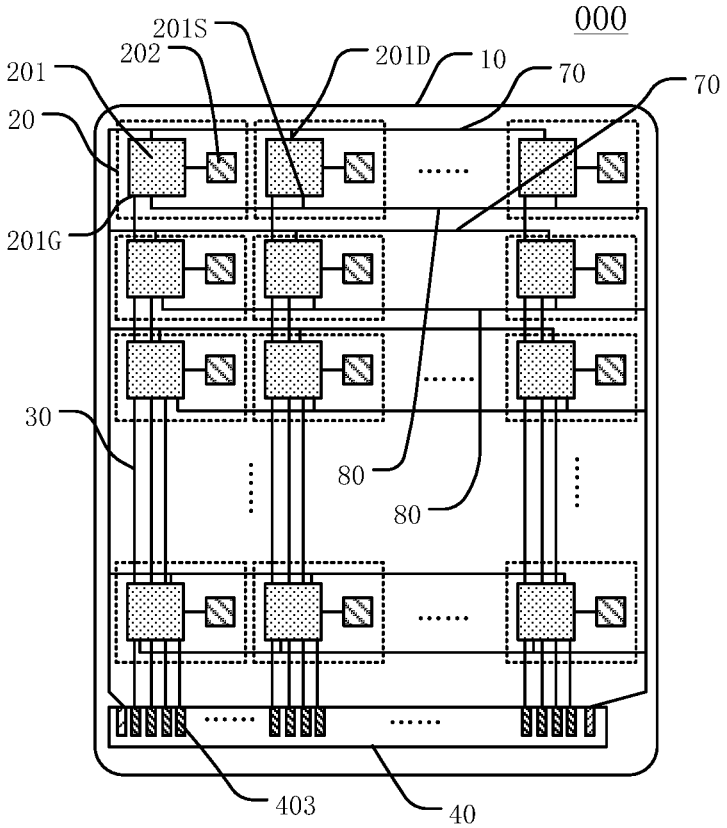
FIG. 12 illustrates a schematic top-view of another exemplary light-emitting panel using a brightness adjustment method in FIG. 1 to emit light consistent with disclosed embodiments of the present disclosure.
Figure 13:
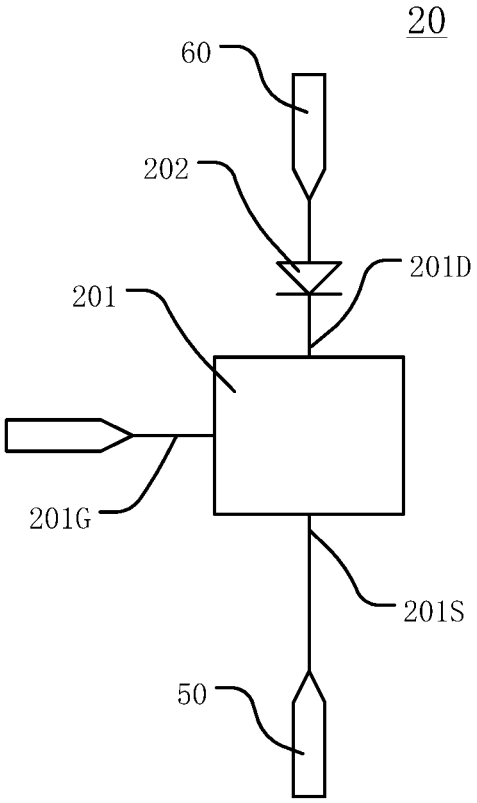
FIG. 13 illustrates a schematic diagram of a circuit connection structure of a light-emitting unit in FIG. 12.
Figure 14:
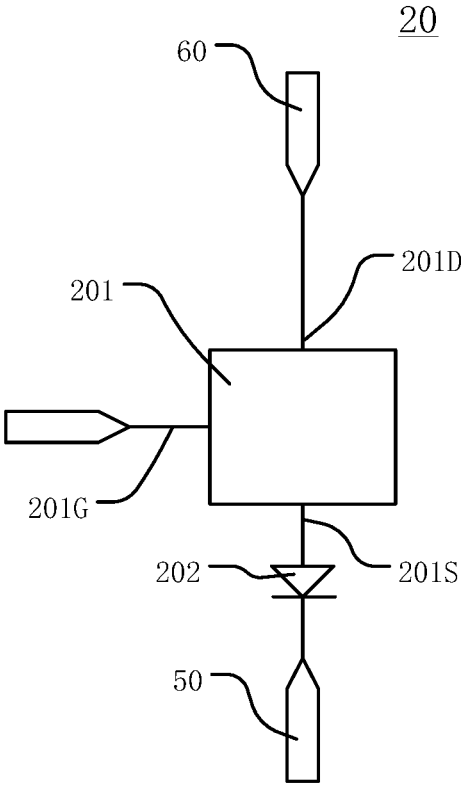
FIG. 14 illustrates a schematic diagram of another circuit connection structure of a light-emitting unit in FIG. 12.
Figure 15:
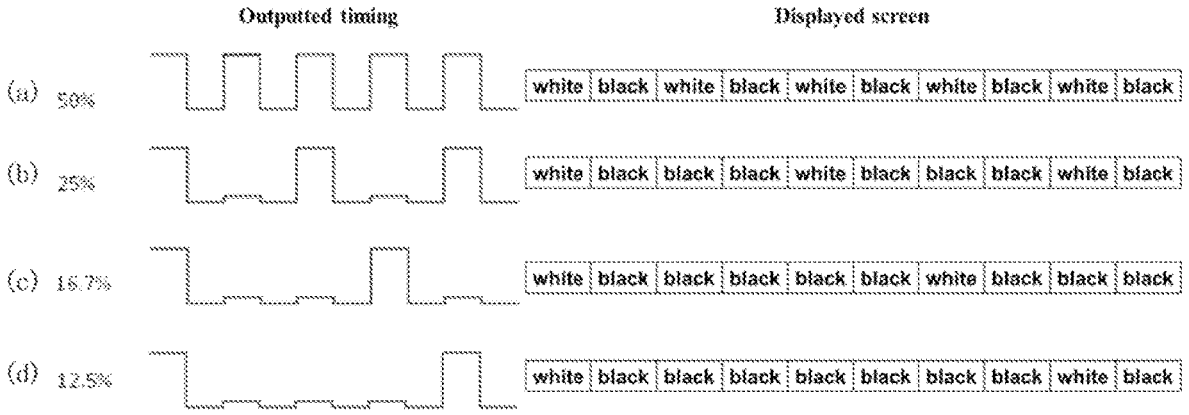
FIG. 15 illustrates a schematic diagram of a light-emitting brightness level corresponding to a first pulse width modulation signal provided by a control circuit consistent with disclosed embodiments of the present disclosure.
Figure 16:
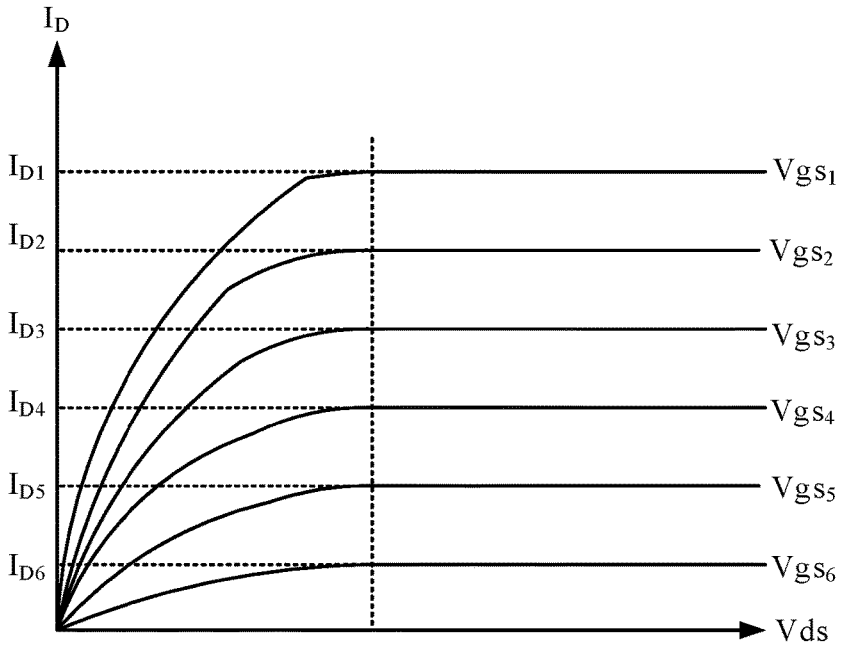
FIG. 16 illustrates a diagram of a correspondence relationship between a voltage difference between a control terminal and a second terminal of a light-emitting control unit and a current flowing through a light-emitting element consistent with disclosed embodiments of the present disclosure.

FIG. 12 illustrates a schematic top-view of another light-emitting panel using a brightness adjustment method in FIG. 1 to emit light; FIG. 13 illustrates a schematic diagram of a circuit connection structure of the light-emitting unit in FIG. 12; FIG. 14 illustrates a schematic diagram of another circuit connection structure of the light-emitting unit in FIG. 12; FIG. 15 illustrates a schematic diagram of the light-emitting brightness level corresponding to a first pulse width modulation signal provided by a control circuit; and FIG. 16 illustrates a diagram of a correspondence relationship between a voltage difference between a control terminal and a second terminal of a light-emitting control unit and a current flowing through a light-emitting element.

In certain embodiments, referring to FIG. 1, FIGS. 9-10, and FIGS. 12-16, each light-emitting unit 20 of the light-emitting panel 000 may include a light-emitting control unit 201 and a light-emitting element 202 electrically connected to the light-emitting control unit 201. The light-emitting control unit 201 may be configured to provide a driving current to the light-emitting element 202. Each signal line 30 may connect a control terminal 201G of the light-emitting control unit 201 in a light-emitting unit 20 with the first signal terminal 403. The light-emitting control unit 201 may further include a first terminal 201D and a second terminal 201S. The second terminal 201S may be connected to a first power supply terminal 50, and the first terminal 201D may be connected to a second power supply terminal 60.

In one embodiment, for a light-emitting unit 20, according to the different duty cycle of the first pulse width modulation signal provided by the pulse control unit 405, the light-emitting control unit 201 connected with the corresponding light-emitting element 202 may be controlled to have a different on-period, thereby controlling the magnitude of the current flowing through the light-emitting element 202. The change of the duty cycle of the first pulse width modulation signal may be $1/n\times100\%$, then one light-emitting unit 20 may correspondingly output M-level light-emitting brightness, where n may be an even number, and M may be a quantity of n and may be a positive integer. For example, n may be an even number of 2, 4, 6, 8, 10, or more, and M-level may indicate how many groups of n are selected.

According to the different first voltage signal provided by the voltage adjustment unit 404, the voltage difference Vgs between the control terminal 201G and the second terminal 201S of the light-emitting control unit 201 may be different. The voltage difference Vgs between the control terminal 201G and the second terminal 201S of the light-emitting control unit 201 may have Q change gradients, and may correspondingly generate Q change gradients of current ID flowing through the light-emitting element 202. Therefore, the light-emitting unit 20 may output Q-level light-emitting brightness, where Q may be a positive integer.

Based on the interaction between the first pulse width modulation signal and the first voltage signal, the quantity of ultimate change gradients of light-emitting brightness generated by the light-emitting unit 20 may be W, where $W\leq M\times Q$, and W may be a positive integer.

The disclosed embodiments may explain that each light-emitting unit 20 may include the light-emitting control unit 201 and the light-emitting element 202 electrically connected to the light-emitting control unit 201. The light-emitting control unit 201 may be configured to provide a driving current to the light-emitting element 202 to drive the light-emitting element 202 to emit light. Optionally, the light-emitting control unit 201 may include a control transistor or a module structure formed by combining and connecting a plurality of control transistors. The control transistor may include a thin film transistor, a metal-oxide-semiconductor field-effect transistor, or a combination thereof. For illustrative purposes, FIGS. 12-14 may illustrate the light-emitting control unit 201 using a block diagram. Optionally, the light-emitting element 202 in the present disclosure may be any one of a micro light-emitting diode (Micro LED) or a sub-millimeter light-emitting diode (Mini LED), which may not be limited by the present disclosure and may be set according to practical applications.

Each signal line 30 may connect the control terminal 201G of the light-emitting control unit 201 in one light-emitting unit 20 with the first signal terminal 403. The light-emitting control unit 201 of the light-emitting unit 20 may further include a first terminal 201D and a second terminal 201S. The second terminal 201S may be connected to the first power supply terminal 50, and the first terminal 201D may be connected to the second power supply terminal 60. Optionally, the light-emitting element 202 may be located between the first terminal 201D and the second power supply terminal 60 (as shown in FIG. 13), or may be located between the second terminal 201S and the first power supply terminal 50 (as shown in FIG. 14), which may not be limited by the present disclosure. The light-emitting element 202 may merely need to be disposed between the first power supply terminal 50 and the second power supply terminal 60, such that the driving current may pass through the light-emitting element 202 when the light-emitting control unit 201 is turned on. Optionally, the first power supply terminal 50 and the second power supply terminal 60 of the light-emitting unit 20 may be connected to a power signal, for providing each light-emitting unit 20 with a negative power signal PVEE and a positive power signal PVDD. Further, optionally, the first power supply terminals 50 of every light-emitting unit 20 may be connected together, the second power supply terminals 60 of every light-emitting unit 20 may be connected together, and the control circuit 40 may provide a unified power signal, which may facilitate to reduce the quantity of wirings on the light-emitting panel 000.

The disclosed embodiments may explain that in the brightness adjustment method of the light-emitting panel, referring to FIG. 15, for one light-emitting unit 20, according to the different duty cycle of the first pulse width modulation signal provided by the pulse control unit 405, one light-emitting unit 20 may output M-level light-emitting brightness, and the duty cycle of the first pulse width modulation signal may be 1/n×100%, where n may be an even number, M may be a quantity n and may be a positive integer.

The control circuit 40 may be integrated into the first chip. The first chip may directly use the source driving chip. Due to the polarity inversion of the source driving chip (the characteristic that one positive and one negative, one positive and several negative, or several positive and several negative are reversed sequentially), according to the relationship between gray scale and voltage (gamma curve function relationship with polarity reversal at the same time), the pulse control unit 405 integrated in the first chip may not only change the amplitude of the first voltage signal generated by the first chip, but also adjust the pulse width of the generated pulse signal. Therefore, the first signal terminal 403 of the control circuit 40 integrated into the first chip may provide a pulse signal with polarity inversion for the control terminal 201G of the light-emitting control unit 201 of the light-emitting unit 20, which may be ultimately expressed as that the output signal is a waveform diagram of the duty cycle of the first pulse width modulation signal.

FIG. 15 (*a*) illustrates that n may be 2 and the duty cycle of the first pulse width modulation signal may be 50%. The outputted timing diagram may be shown in the left of FIG. 15 (*a*), and the display screen corresponding to the outputted timing diagram may be understood as the right of FIG. 15 (*a*). FIG. 15 (*b*) illustrates that n may be 4 and the duty cycle of the first pulse width modulation signal may be 25%. FIG. 15 (*c*) illustrates that n may be 6 and the duty cycle of the first pulse width modulation signal may be 16.9%. FIG. 15 (*d*) illustrates that n may be 8 and the duty cycle of the first pulse width modulation signal may be 12.5%, and so on. When the value of n is different, the duty cycle of the first pulse width modulation signal may be different, and the gradient of the light-emitting brightness outputted by the light-emitting unit 20 may be different. In other words, the quantity of values of n may be M, and one light-emitting unit 20 may output M-level light-emitting brightness.

At the same time, for a light-emitting unit 20, according to the different first voltage signal provided by the voltage adjustment unit 404, the voltage difference Vgs between the control terminal 201G and the second terminal 201S of the light-emitting control unit 201 may be different. The voltage difference Vgs between the control terminal 201G and the second terminal 201S of the light-emitting control unit and the current ID flowing through the light-emitting element 202 may have a correspondence relationship as shown in FIG. 16, which may be similar to one-to-one correspondence relationship between the gray-scale brightness in the gamma curve (expressed as the current of the light-emitting element) and the gamma voltage, and the correspondence relationship may be discrete. Therefore, because the voltage difference Vgs between the control terminal 201G and the second terminal 201S of the light-emitting control unit 201 is different, when the voltage difference Vgs between the control terminal 201G and the second terminal 201S of the light-emitting control unit 201 has Q change gradients, Q change gradients of current ID (FIG. 16 illustrates an increased gradient change as an example) flowing through the light-emitting element 202 may be correspondingly generated. Therefore, the light-emitting unit 20 may output Q-level light-emitting brightness as shown in FIG. 16, where Q may be a positive integer. The abscissa in FIG. 16 may represent the voltage difference Vds between the first terminal 201D and the second terminal 201S of the light-emitting control unit 201, and the ordinate may represent the current ID flowing through the light-emitting element 202.

In the present disclosure, the light-emitting brightness of the light-emitting unit 20 may be simultaneously subjected to the two factors of the duty cycle of the first pulse width modulation signal shown in FIG. 15 and the first voltage signal shown in FIG. 16, and a quantity of light-emitting brightness generated by the light-emitting unit 20 may be W, where W≤M×Q, and W may be a positive integer. For illustrative purposes, M may be four and Q may be six. Therefore, the quantity of duty cycles of the first pulse width modulation signal may be four. In other words, according to the provided four different duty cycles of the first pulse width modulation signal, one light-emitting unit 20 may output 4-level light-emitting brightness. At the same time, the provided six different first voltage signals may correspond to six different voltage differences Vgs between the control terminal 201G and the second terminal 201S of the light-emitting control unit. The six voltage differences Vgs1, Vgs2, Vgs3, Vgs4, Vgs5, Vgs6 between the control terminal 201G and the second terminal 201S of the light-emitting control unit may correspond to six currents ID flowing through the light-emitting element 202. The six currents hi, ID2, ID3, ID4, ID5, ID6 flowing through the light-emitting element 202 may change in a gradient, and the light-emitting unit 20 may output 6-level light-emitting brightness. Then, the quantity W of light-emitting brightness ultimately generated by the light-emitting unit 20 may be less than or equal to twenty-four, while may be greater than four or six. The brightness adjustment method of the light-emitting panel 000 in the present disclosure may simultaneously control the length of on-period of the light-emitting element 202 through the duty cycle of the first pulse width modulation signal, and may control the amplitude of the conduction current flowing through the light-emitting element 202 by controlling the amplitude of the voltage difference Vgs between the control terminal 201G and the second terminal 201S of the light-emitting control unit 201 through the first voltage signal. Therefore, the light-emitting element 202 of the light-emitting unit 20 may produce different light-emitting brightness, may provide more different gray-scale brightness, and may achieve substantially fine dimming. When being used as a display, the light-emitting panel 000 may meet the requirements of high-resolution display and may improve the display quality.

Optionally, as shown in following Table 1 (it should be understood that the numbers in Table 1 may merely be examples and may not indicate specific voltages, etc.), assuming that the first signal terminal 403 may provide six different voltage differences (a first column in following Table 1) between the control terminal 201G and the second terminal 201S of the light-emitting control unit for a light-emitting unit 20, and at the same time, the first signal terminal 403 may provide four different duty cycles of the first pulse width modulation signal (a first row in following Table 1) for the light-emitting unit 20. The two factors may work together to make the light-emitting brightness generated by the light-emitting unit 20 change as shown in the following Table, and may generate 24 different light-emitting brightness. Because there may be the same light-emitting brightness, such as the two sets of overlapped data indicated by 0.25 and 0.125 in the Table, the light-emitting unit 20 may generate 22 different light-emitting brightness.

TABLE I

| | 1/n × 100% | | | |
|---|---|---|---|---|
| Vgs | 50% | 25% | 16.7% | 12.5% |
| 1 | 0.5 | **0.25** | 0.167 | **0.125** |
| 0.9 | 0.45 | 0.225 | 0.1503 | 0.1125 |
| 0.8 | 0.4 | 0.2 | 0.1336 | 0.1 |
| 0.7 | 0.35 | 0.175 | 0.1169 | 0.0875 |
| 0.6 | 0.3 | 0.15 | 0.1002 | 0.075 |
| 0.5 | **0.25** | **0.125** | 0.0835 | 0.0625 |

Compared with the scheme where merely four different light-emitting brightness may be generated through four different duty cycles of the first pulse width modulation signal, or merely six different light-emitting brightness may be generated through six different voltage differences between the control terminal 201G and the second terminal 201S of the light-emitting control unit, the brightness adjustment method in the present disclosure may be configured to simultaneously control the two factors controlling the on-period and the conduction current of the light-emitting unit 20. Based on the interaction effects of the first pulse width modulation signal and the first voltage signal, more kinds of brightness gradient changes may be adjusted compared with the existing adjustment method of using the pulse width modulation signal. According to the correspondence relationship between different brightness and the first pulse width modulation signal as well as the first voltage signal, the brightness interval may be divided to obtain the correspondence relationship between the different grayscale value and the first pulse width modulation signal as well as the first voltage signal. Therefore, different light-emitting unit 20 may generate corresponding light-emitting brightness according to the requirements of different grayscale value, and, thus, may achieve substantially fine dimming to provide more kinds of different gray-scale brightness. When the light-emitting panel 000 is used as a backlight or a display, the requirements of high-resolution backlight or display may be satisfied, which may improve the display quality and may provide favorable conditions for high-resolution display.

Figure 17:
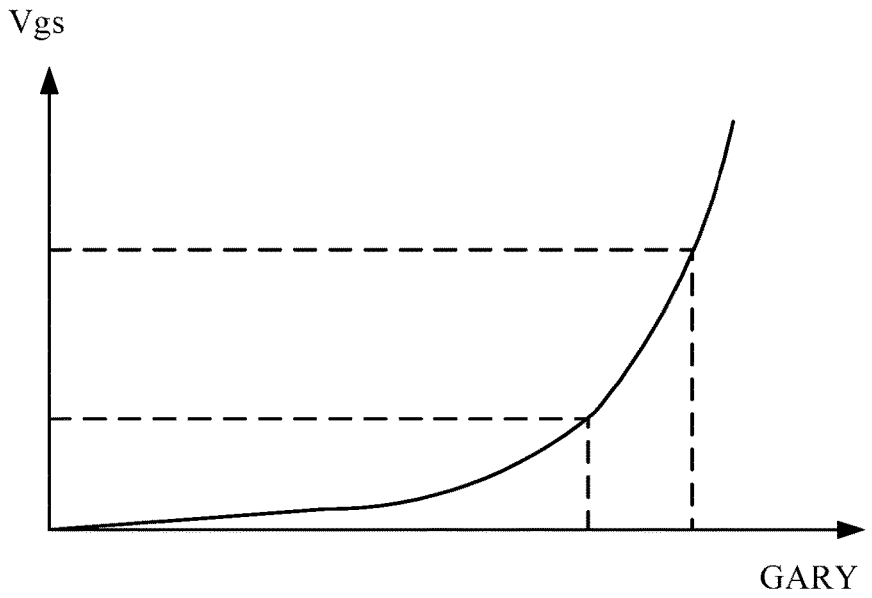
FIG. 17 illustrates a diagram of a correspondence relationship between a voltage difference between a control terminal and a second terminal of a light-emitting control unit and a display gray scale of a corresponding light-emitting element consistent with disclosed embodiments of the present disclosure.

FIG. 17 illustrates a diagram of a correspondence relationship between the voltage difference between the control terminal and the second terminal of the light-emitting control unit and a display gray scale of a corresponding light-emitting element. The ordinate in FIG. 17 may represent the voltage difference Vgs between the control terminal and the second terminal of the light-emitting control unit, and the abscissa may represent the display gray scale GARY of the corresponding light-emitting element. In certain embodiments, referring to FIG. 1, FIGS. 9-10, and FIGS. 12-17, in the brightness adjustment method of the light-emitting panel 000 in the present disclosure, according to the different first voltage signal provided by the voltage adjustment unit 404, the voltage difference Vgs between the control terminal 201G and the second terminal 201S of the light-emitting control unit 201 may be different. The Q voltage differences Vgs between the control terminal 201G and the second terminal 201S of the light-emitting control unit 201 may correspond to Q currents ID flowing through the light-emitting element 202. The Q currents ID flowing through the light-emitting element 202 may change in a gradient, and the light-emitting unit 20 may output Q-level light-emitting brightness.

The correspondence relationship may include Vgs=f(G) and ID=g(f(G)). Vgs may be the voltage difference between the control terminal 201G and the second terminal 201S of the light-emitting control unit 201, G may be the light-emitting gray scale of the light-emitting element corresponding to the current ID flowing through the light-emitting element 202, and f may be the gamma curve function. ID may be the current flowing through the light-emitting element 202, and g may be the relationship function between the voltage difference Vgs between the control terminal 201G and the second terminal 201S of the light-emitting control unit 201 and the current ID of the light-emitting element 202.

The disclosed embodiments may explain that the relationship between the voltage difference Vgs between the control terminal 201G and the second terminal 201S of the light-emitting control unit 201 of each light-emitting unit 20 and the display gray scale G of the corresponding light-emitting element 202 may be understood as the relationship between the gamma voltage in the gamma curve (similar to an exponential relationship) and the display gray scale. Different gray scale may correspond to different voltage. The gray scales may be discrete positive integers, such that the corresponding voltages may be discrete. The current ID flowing through the light-emitting element 202 and the voltage difference Vgs between the control terminal 201G and the second terminal 201S of the light-emitting control unit 201 may have a g-function relationship, such that the different first voltage signal may control the voltage difference Vgs between the control terminal 201G and the second terminal 201S of the light-emitting control unit 201 to be different, may make the conduction current of the light-emitting element 202 be different, and may make the current ID flowing through the light-emitting element 202 be different. Therefore, the light-emitting unit 20 may output different light-emitting brightness. According to the different light-emitting brightness, the brightness interval may be divided to obtain the correspondence relationship between the different grayscale value and the brightness level, and then may obtain the correspondence relationship between the different grayscale value and the first pulse width modulation signal as well as the first voltage signal. Therefore, different light-emitting unit 20 may generate corresponding light-emitting brightness according to the requirements of different grayscale value, and, thus, may achieve substantially fine dimming to provide more kinds of different gray-scale brightness. When the light-emitting panel 000 is used as a display, the requirements of high-resolution display may be satisfied, which may improve the display quality.

Optionally, the current ID flowing through the light-emitting element 202 in the present disclosure may have a following relationship: $I_D=g(f(G))=g(Vgs)$, where g may be relationship function between the voltage difference Vgs between the control terminal 201G and the second terminal 201S of the light-emitting control unit 201 and the current $I_D$ of the light-emitting element 202. The relationship function g may satisfy: $I_D=I_{dss}(1-V_{gs}/V_{gs(off)})^2$, where $I_{dss}$ may refer to the leakage current between the first terminal 201D and the second terminal 201S under the preset voltage difference Vds between the first terminal 201D and the second terminal 201S of the light-emitting control unit 201 when the voltage difference Vgs between the control terminal 201G and the second terminal 201S is zero, and $V_{gs(off)}$ may refer to a threshold voltage when the light-emitting control unit 201 is turned off and the current disappears.

Figure 18:
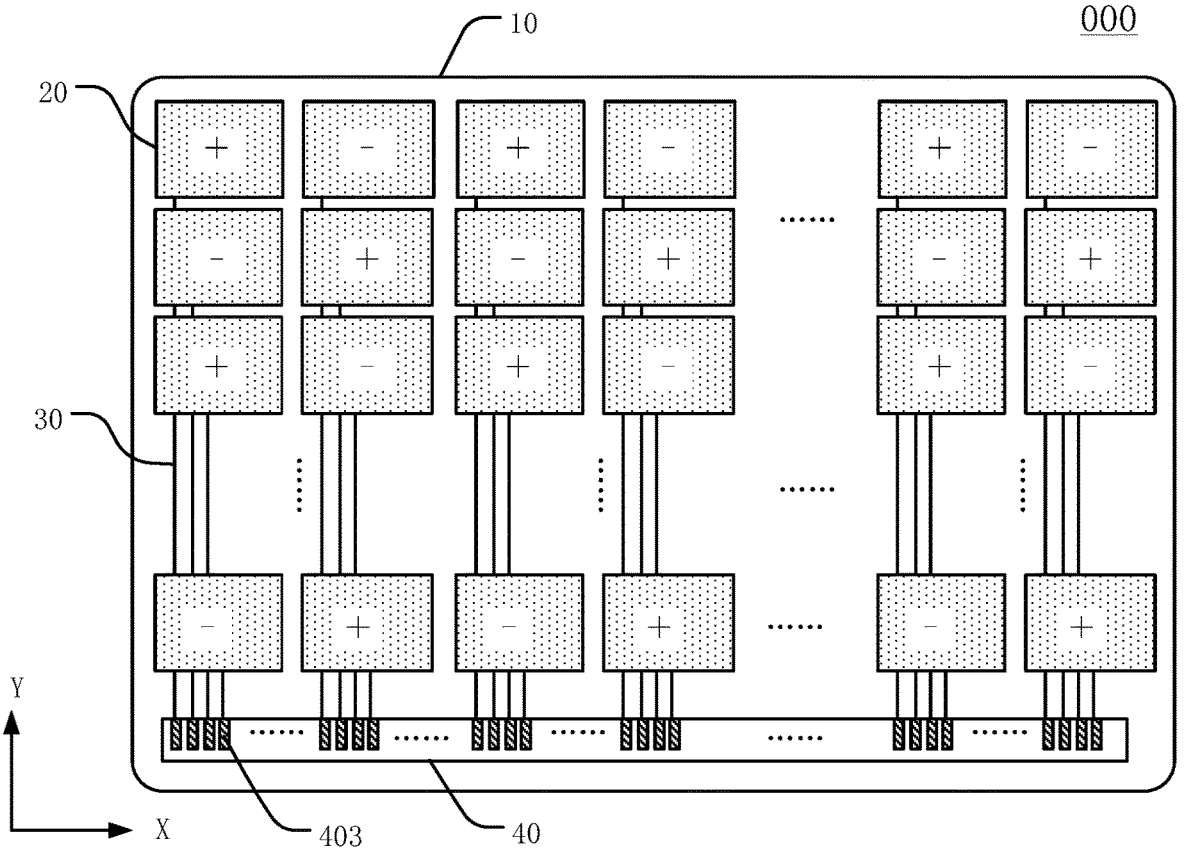
FIG. 18 illustrates a schematic diagram of light-emitting brightness of each light-emitting unit within a period of displaying one frame of a displayed screen consistent with disclosed embodiments of the present disclosure.

FIG. 18 illustrates a schematic diagram of brightness of each light-emitting unit within a period of displaying one frame of a displayed screen consistent with disclosed embodiments of the present disclosure. In certain embodiments, referring to FIG. 1, FIGS. 9-10, and FIGS. 12-18, in the brightness adjustment method of the light-emitting panel in the present disclosure, within a period of displaying one frame of a displayed screen, the first voltage signals applied to the signal lines 30 correspondingly connected to the two adjacent light-emitting units 20 in the light-emitting panel may have opposite polarities, such that within the period of displaying one frame of the displayed screen, the adjacent two light-emitting units 20 may be alternately displayed.

The disclosed embodiments may explain that when applying a first voltage signal to the light-emitting unit 20 through the first signal terminal 403 and the signal line 30 of the control circuit 40, the first voltage signals applied to the signal lines 30 correspondingly connected to the two adjacent light-emitting units 20 in the light-emitting panel 000 may have opposite polarities. The plurality of light-emitting units 20 may be arranged in an array. Multiple light-emitting units 20 arranged along the first direction X may form a row, and light-emitting units 20 arranged in the second direction Y may form a column. The two adjacent light-emitting units 20 may refer to two adjacent light-emitting units 20 arranged along the first direction X or two adjacent light-emitting units 20 arranged along the second direction Y.

Because within the period of displaying one frame of the displayed screen, the first voltage signals applied to the signal lines 30 correspondingly connected to the two adjacent light-emitting units 20 in the light-emitting panel 000 have opposite polarities, such that within the period of displaying one frame of the displayed screen, the adjacent two light-emitting units 20 may be alternately displayed. For the entire light-emitting panel 000, within the period of displaying one frame of the displayed screen, the applied first voltage signal with positive polarity may make a corresponding light-emitting unit 20 be in a bright state, and the applied first voltage signal with negative polarity may make the corresponding light-emitting unit 20 be in a dark state. According to the brightness adjustment method in the present disclosure where within the period of displaying one frame of the displayed screen, the first voltage signals applied to the signal lines 30 correspondingly connected to the two adjacent light-emitting units 20 in the light-emitting panel may have opposite polarities, the light-emitting brightness of each light-emitting unit presented within the period of displaying one frame of the displayed screen may be shown in FIG. 18.

Therefore, when a refresh frequency of the light-emitting panel 000 is substantially high, the period of displaying one frame of the displayed screen may be divided, such that the two adjacent light-emitting units 20 may emit light alternately. In other words, the period of displaying one frame of the displayed screen may divided into a first sub-frame period and a second sub-frame period. Taking light-emitting units in a row as an example, the odd-numbered light-emitting unit in the row may emit light in the first sub-frame period, and the even-numbered light-emitting unit in the row may emit light in the second sub-frame period. Within the first sub-frame period and the second sub-frame period, the light-emitting units in adjacent two rows may emit light in a staggered manner, such that the entire displayed screen may be substantially uniform, and the screen flicker phenomenon affecting the display effect may be prevented from being observed.

Optionally, the brightness adjustment method of the light-emitting panel in the present disclosure may be used when the refresh frequency is substantially high. The refresh frequency may indicate the speed at which the image is updated on the screen, i.e., the number of times that the image appears on the screen per second. The higher the refresh rate, the smaller the image flicker on the screen, and the higher the stability. When the refresh frequency of the light-emitting panel 000 in the present disclosure is greater than or equal to 120 Hz, the foregoing brightness adjustment method, where within the period of displaying one frame of the displayed screen, the first voltage signals applied to the signal lines 30 correspondingly connected to the two adjacent light-emitting units 20 may have opposite polarities, may be adopted, such that the entire displayed screen may be substantially uniform.

Figure 20:
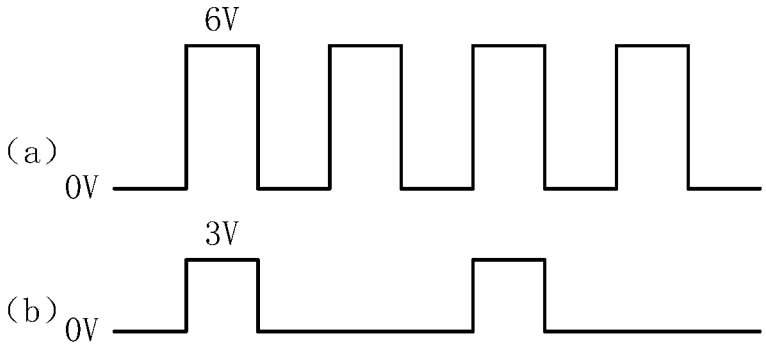
FIG. 20 illustrates a diagram of different waveforms corresponding to a first grayscale value and a second grayscale value consistent with disclosed embodiments of the present disclosure.
Figure 21:
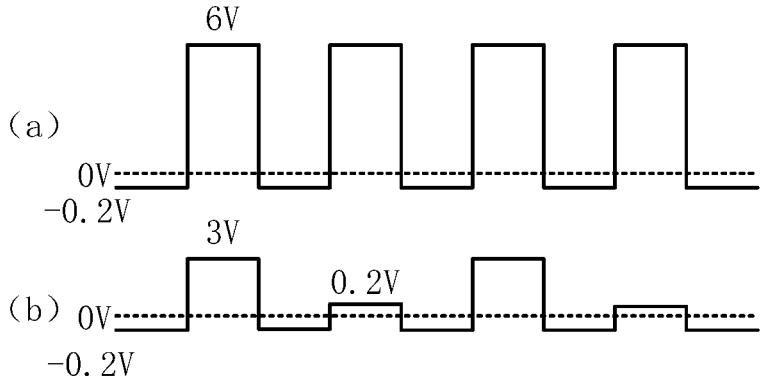
FIG. 21 illustrates another diagram of different waveforms corresponding to a first grayscale value and a second grayscale value consistent with disclosed embodiments of the present disclosure.

FIG. 20 illustrates a diagram of different waveforms corresponding to a first grayscale value and a second grayscale value consistent with disclosed embodiments of the present disclosure; and FIG. 21 illustrates another diagram of different waveforms corresponding to a first grayscale value and a second grayscale value consistent with disclosed embodiments of the present disclosure. In certain embodiments, referring to FIGS. 1-18 and FIG. 20, the light-emitting panel 000 in the present disclosure may adopt the above-disclosed brightness adjustment method to generate different light-emitting brightness. The light-emitting panel 000 may include the substrate 10, and the plurality of light-emitting units 20 arranged in an array on the substrate 10. The light-emitting panel 000 may further include the control circuit 40 and the plurality of signal lines 30 disposed on the substrate 10. The control circuit 40 may include the data signal input terminal 401, the data storage unit 402, and the plurality of first signal terminals 403. The data storage unit 402 may be configured to store the first voltage signal and the first pulse width modulation signal corresponding to the different grayscale value.

The data signal input terminal 401 may be electrically connected with the data storage unit 402, the data storage unit 402 may be electrically connected with the plurality of first signal terminals 403, and each signal line 30 may connect a light-emitting unit 20 with a first signal terminal 403.

In the light-emitting stage, the data storage unit 402 may provide different first pulse width modulation signal and different first voltage signal to the first signal terminal 403. Each light-emitting unit 20 may include a first grayscale value and a second grayscale value different from the first grayscale value. The first grayscale value may correspond to a first pulse signal outputted from the first signal terminal 403, and the second grayscale value may correspond to a second pulse signal outputted from the first signal terminal 403. Comparing the first grayscale value and the second grayscale value, the first pulse signal and the second pulse signal may have different amplitudes, and the first pulse signal and the second pulse signal may have different pulse widths.

The present disclosure also provides a light-emitting panel 000. The light-emitting panel 000 may adopt the above-disclosed brightness adjustment method to emit light. The light-emitting panel 000 may include a substrate 10, and the substrate 10 may serve as a carrier to carry related structures for fabricating the light-emitting panel 000. The light-emitting panel 000 may also include a plurality of light-emitting units 20 arranged in an array on the substrate 10. Moreover, the light-emitting panel 000 may include a control circuit 40 and a plurality of signal lines 30 disposed on the substrate 10. The control circuit 40 may include a data signal input terminal 401, a data storage unit 402, and a plurality of first signal terminals 403.

The data signal input terminal 401 may be electrically connected with the data storage unit 402. The data signal input terminal 401 may be configured to provide an external control signal source to the data storage unit 402, to control the data call and data output of the data storage unit 402. The data storage unit 402 may be electrically connected with the plurality of first signal terminals 403, and each signal line 30 may connect a light-emitting unit 20 with a first signal terminal 403. The data storage unit 402 may be configured to store a first voltage signal and a first pulse width modulation signal corresponding to a different grayscale value. According to the different grayscale value corresponding to the different light-emitting unit 20 in the to-be-displayed screen of the light-emitting panel 000, the pulse width modulation signal and the first voltage signal corresponding to each grayscale value in the data storage unit 402 may be called. Under the control of the external control signal source of the data signal input terminal 401, the pulse width modulation signal and the first voltage signal corresponding to each grayscale value may be transmitted to each light-emitting unit 20 through the signal lines 30 and the plurality of first signal terminals 403 of the control circuit 40, to make each light-emitting unit 20 generate light-emitting brightness corresponding to the above-mentioned grayscale value, thereby achieving the display of the to-be-displayed screen.

In the disclosed light-emitting panel 000, in the light-emitting stage, the data storage unit 402 may provide different first pulse width modulation signal and different first voltage signal to the first signal terminal 403. If each light-emitting unit 20 includes the first grayscale value and the second grayscale value with different grayscale values (different brightness), the first grayscale value of the light-emitting unit 20 may correspond to the first pulse signal outputted from the first signal terminal 403, and the second grayscale value of the light-emitting unit 20 may correspond to the second pulse signal outputted from the first signal terminal 403. Both the first pulse signal and the second pulse signal may be embodied as a waveform signal. Comparing the first grayscale value and the second grayscale value, the first pulse signal and the second pulse signal may have different amplitudes, and the first pulse signal and the second pulse signal may have different pulse widths. It should be noted that the pulse widths of the first pulse signal and the second pulse signal may refer to a sum of durations of the high levels within a certain pulse signal period, respectively.

For illustrative purposes, in one embodiment, referring to FIG. 20, if the first grayscale value is 255 and the second grayscale value is 80, the first pulse signal corresponding to the first grayscale value may have a waveform as shown in FIG. 20(*a*), and the second pulse signal corresponding to the second grayscale value may have a waveform as shown in FIG. 20(*b*). Comparing the first grayscale value and the second grayscale value, the amplitude of the first pulse signal may be approximately 6 V, and the amplitude of the second pulse signal may be approximately 3 V. If the period of the first pulse signal is 100 μs and the duty cycle of the first pulse signal is 50%, the pulse width of the first pulse signal in one period may be 50 μs. If the period of the second pulse signal is 100 μs and the duty cycle of the second pulse signal is 25%, the pulse width of the second pulse signal in one period may be 25 μs. It should be understood that the numbers such as gray scale and voltage amplitude in the disclosed embodiments may be merely examples and may not represent actual values. The first pulse signal and the second pulse signal with different amplitudes may be provided by providing different first voltage signals to the first signal terminal 403 from the data storage unit 402. The first pulse signal and the second pulse signal with different pulse widths may be provided by providing different first pulse width modulation signals to the first signal terminal 403 from the data storage unit 402.

The light-emitting panel 000 in the disclosed embodiment may simultaneously control the two factors controlling the on-period and the conduction current of the light-emitting unit 20 through the first pulse width modulation signal and the first voltage signal. Based on the interaction effects of the first pulse width modulation signal and the first voltage signal, more kinds of brightness gradient changes may be adjusted compared with the existing adjustment method of using the pulse width modulation signal. According to the correspondence relationship between different brightness and the first pulse width modulation signal as well as the first voltage signal, the brightness interval may be divided to obtain the correspondence relationship between the different grayscale value and the first pulse width modulation signal as well as the first voltage signal. Therefore, different light-emitting unit 20 may generate corresponding light-emitting brightness according to the requirements of different grayscale value, and, thus, may provide more kinds of gray-scale brightness with different gradients, to achieve substantially fine dimming. When the light-emitting panel 000 is used as a backlight or a display, the requirements of high-resolution backlight or display may be satisfied, which may improve the display quality.

It should be noted that the light-emitting panel 000 in the disclosed embodiments may be used as a direct backlight including a surface light source, and may also be used as a display panel, which may improve the display resolution through fine dimming to meet the requirements of high-quality display. It should be understood that FIG. 3 merely illustrates the control circuit 40 using a frame structure. In specific implementation, the structure of the control circuit 40 may not be limited to such structure, and may be integrated with any other driving unit, which may not be limited by the present disclosure, as long as the control circuit is capable of providing a driving signal for the light-emitting unit 20 to achieve fine dimming.

It should be understood that the first pulse width modulation signal and the first voltage signal ultimately provided by the control circuit 40 to the control terminal of the light-emitting control unit may also be affected by the low-level turn-off of the transistor (N-type), pixel coupling, and any other process characteristic. The pulse signals corresponding to different light-emitting grayscale values of the light-emitting panel 000 may also have waveforms as shown in FIG. 21. If the first grayscale value is 255, and the second grayscale value is 80, the first pulse signal corresponding to the first grayscale value may have a waveform as shown in FIG. 21(*a*), and the second pulse signal corresponding to the second grayscale value may have a waveform as shown in FIG. 21(*b*). The amplitude of the first pulse signal may be approximately 6 V, while the first pulse signal may also have a potential signal of −0.2 V. The amplitude of the second pulse signal may be approximately 3 V, while the second pulse signal may also have potential signals of −0.2 V and +0.2 V. For illustrative purposes, 0.2 may be merely an example, which may be any other value close to 0.

Figure 22:
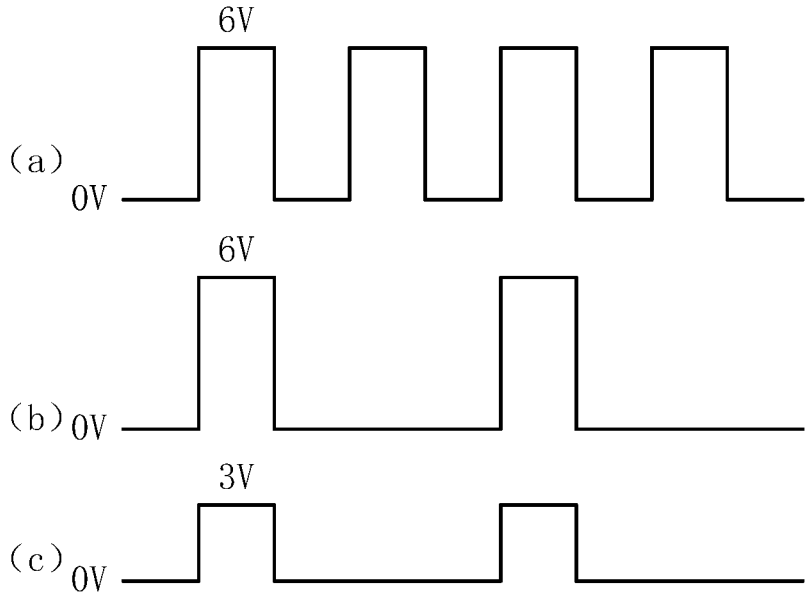
FIG. 22 illustrates a diagram of different waveforms corresponding to a first grayscale value, a second grayscale value, and a third grayscale value consistent with disclosed embodiments of the present disclosure.
Figure 23:
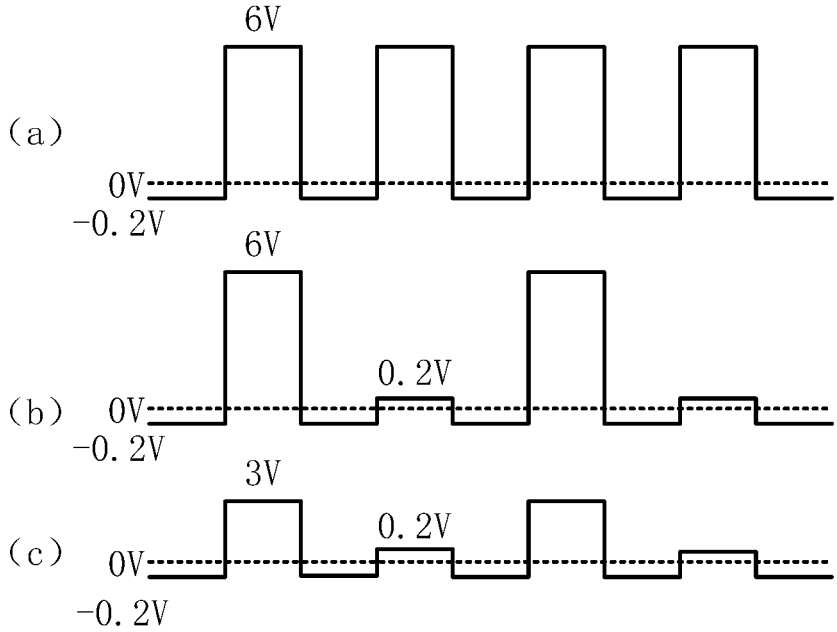
FIG. 23 illustrates another diagram of different waveforms corresponding to a first grayscale value, a second grayscale value, and a third grayscale value consistent with disclosed embodiments of the present disclosure.

FIG. 22 illustrates a diagram of different waveforms corresponding to a first grayscale value, a second grayscale value, and a third grayscale value consistent with disclosed embodiments of the present disclosure; and FIG. 23 illustrates another diagram of different waveforms corresponding to a first grayscale value, a second grayscale value, and a third grayscale value consistent with disclosed embodiments of the present disclosure. In certain embodiments, referring to FIGS. 1-18 and FIGS. 22-23, in the light-emitting stage, the data storage unit 402 may provide different first pulse width modulation signal and different first voltage signal to the first signal terminal 403. Each light-emitting unit 20 may also include a third grayscale value, and the third grayscale value may have a size (brightness) between the first grayscale value and the second grayscale value. The third grayscale value may correspond to a third pulse signal outputted from the first signal terminal 403. Comparing the third grayscale value and the second grayscale value, the third pulse signal and the second pulse signal may have different amplitudes, or the third pulse signal and the second pulse signal may have different pulse widths.

The disclosed embodiments may explain that each light-emitting unit 20 may further include the third grayscale value, and the third grayscale value may have a size (brightness) between the first grayscale value and the second grayscale value. The third grayscale value may correspond to the third pulse signal outputted from the first signal terminal 403. Comparing the third grayscale value and the second grayscale value, the third pulse signal and the second pulse signal may have different amplitudes, or the third pulse signal and the second pulse signal may have different pulse widths. It should be noted that the pulse width difference between the third pulse signal and the second pulse signal may refer to the difference in the sum of durations of the high levels within a certain pulse signal period. Optionally, Comparing the third grayscale value and the first grayscale value, the third pulse signal and the first pulse signal may have different amplitudes, or the third pulse signal and the first pulse signal may have different pulse widths. It should be noted that the pulse width difference between the third pulse signal and the first pulse signal may refer to the difference in the sum of durations of the high levels within a certain pulse signal period.

For illustrative purposes, referring to FIG. 22, if the first grayscale value is 255, the third grayscale value is 130, and the second grayscale value is 80, the first pulse signal corresponding to the first grayscale value may have a waveform as shown in FIG. 22(*a*), the third pulse signal corresponding to the third grayscale value may have a waveform as shown in FIG. 22(*b*), and the second pulse signal corresponding to the second grayscale value may have a waveform as shown in FIG. 22(*c*).

Comparing the third grayscale value and the second grayscale value, the amplitude of the third pulse signal may be approximately 6 V, and the amplitude of the second pulse signal may be approximately 3 V. If the period of the third pulse signal is 100 μs and the duty cycle of the third pulse signal is 25%, the pulse width of the third pulse signal in one period may be 25 μs. If the period of the second pulse signal is 100 μs and the duty cycle of the second pulse signal is 25%, the pulse width of the second pulse signal in one period may be 25 μs. Alternatively, comparing the third grayscale value and the first grayscale value, the amplitude of the third pulse signal may be approximately 6 V, and the amplitude of the first pulse signal may be approximately 6 V. If the period of the third pulse signal is 100 μs and the duty cycle of the third pulse signal is 25%, the pulse width of the third pulse signal in one period may be 25 μs. If the period of the first pulse signal is 100 μs and the duty cycle of the first pulse signal is 50%, the pulse width of the first pulse signal in one period may be 50 μs. It should be understood that the numbers such as gray scale and voltage amplitude in the disclosed embodiments may be merely examples and may not represent actual values.

The third pulse signal and the second pulse signal with different amplitudes may be provided by providing different first voltage signals to the first signal terminal 403 from the data storage unit 402. Alternatively, the first pulse signal and the third pulse signal with different pulse widths may be provided by providing different first pulse width modulation signals to the first signal terminal 403 from the data storage unit 402. Therefore, according to the correspondence relationship between different brightness and the first pulse width modulation signal or the correspondence relationship between different brightness and the first voltage signal, the brightness interval may be divided to obtain the correspondence relationship between the different grayscale value and the first pulse width modulation signal as well as the first voltage signal. Therefore, different light-emitting unit 20 may generate corresponding light-emitting brightness according to the requirements of different grayscale value, and, thus, may provide more kinds of gray-scale brightness with different gradients, to achieve substantially fine dimming. When the light-emitting panel 000 is used as a backlight or a display, the requirements of high-resolution backlight or display may be satisfied, which may improve the display quality.

It should be understood that the first pulse width modulation signal and the first voltage signal ultimately provided by the control circuit 40 to the control terminal of the light-emitting control unit may also be affected by the low-level turn-off of the transistor (N-type), pixel coupling, and any other process characteristic. The pulse signals corresponding to different light-emitting grayscale values of the light-emitting panel 000 may also have waveforms as shown in FIG. 23. If the first grayscale value is 255, the third grayscale value is 130, and the second grayscale value is 80, the first pulse signal corresponding to the first grayscale value may have a waveform as shown in FIG. 23(*a*), the third pulse signal corresponding to the third grayscale value may have a waveform as shown in FIG. 23(*b*), and the second pulse signal corresponding to the second grayscale value may have a waveform as shown in FIG. 23(*c*). The amplitude of the first pulse signal may be approximately 6 V, while the first pulse signal may also have a potential signal of −0.2 V. The amplitude of the second pulse signal may be approximately 3 V, while the second pulse signal may also have potential signals of −0.2 V and +0.2 V. The amplitude of the third pulse signal may be approximately 6 V, while the third pulse signal may also have potential signals of −0.2 V and +0.2 V. For illustrative purposes, 0.2 may be merely an example, which may be any other value close to 0.

In certain embodiments, referring to FIG. 1, FIGS. 9-10, and FIGS. 12-14, in the disclosed light-emitting panel 000, each light-emitting unit 20 may include a light-emitting control unit 201 and a light-emitting element 202 electrically connected to the light-emitting control unit 201. The light-emitting control unit 201 may be configured to provide a driving current to the light-emitting element 202. Each signal line 30 may connect a control terminal 201G of the light-emitting control unit 201 in the light-emitting unit 20 with the first signal terminal 403.

The disclosed embodiments may explain that each light-emitting unit 20 may include the light-emitting control unit 201 and the light-emitting element 202 electrically connected to the light-emitting control unit 201. The light-emitting control unit 201 may be configured to provide a driving current to the light-emitting element 202 to drive the light-emitting element 202 to emit light. Optionally, the light-emitting control unit 201 may include a control transistor or a module structure formed by combining and connecting a plurality of control transistors. The control transistor may include a thin film transistor, a metal-oxide-semiconductor field-effect transistor, or a combination thereof. For illustrative purposes, FIGS. 12-14 may illustrate the light-emitting control unit 201 using a block diagram. Optionally, the light-emitting element 202 in the present disclosure may be any one of a micro light-emitting diode (Micro LED) or a sub-millimeter light-emitting diode (Mini LED), which may not be limited by the present disclosure and may be set according to practical applications.

Each signal line 30 may connect the control terminal 201G of the light-emitting control unit 201 in one light-emitting unit 20 with the first signal terminal 403. Optionally, the control terminal 201G of the light-emitting control unit 201 in each light-emitting unit 20 may be connected to at least one signal line 30, and the signal transmission between the control terminal 201G of the light-emitting control unit 201 in the light-emitting unit 20 and the first signal terminal 403 of the control circuit 40 may be achieved through the at least one signal line 30. Optionally, the control terminal 201G of the light-emitting control unit 201 in each light-emitting unit 20 may be connected to two or three signal lines 30, and the signal transmission between the control terminal 201G of the light-emitting control unit 201 in the light-emitting unit 20 and the first signal terminal 403 of the control circuit 40 may be achieved through the multiple signal lines 30, which may facilitate to reduce the impedance of the transmission signal.

In certain embodiments, referring to FIG. 1, FIGS. 9-10, and FIGS. 12-14, in the disclosed light-emitting panel 000, each light-emitting unit 20 may further include a first power supply terminal 50, and a second power supply terminal 60 electrically connected to the first power supply terminal 50. The first power supply terminal 50 may provide a first power signal PVEE for the light-emitting unit 20, and the second power supply terminal 60 may provide a second power signal PVDD for the light-emitting unit 20.

The disclosed embodiments may explain that each light-emitting unit 20 may further include a first power supply terminal 50 and a second power supply terminal 60 electrically connected to the first power supply terminal 50. The first power supply terminal 50 and the second power supply terminal 60 of the light-emitting unit 20 may be connected to a power signal, and may be configured to provide the first power signal PVEE and the second power signal PVDD for each light-emitting unit 20. Optionally, the second power signals PVDD of every light-emitting unit 20 may be equal, and the first power signals PVEE of every light-emitting unit 20 may be equal. Further, the first power supply terminals 50 of every light-emitting unit 20 may be connected together, the second power supply terminals 60 of every light-emitting unit 20 may be connected together, and the control circuit 40 may provide unified second power signal PVDD and first power signal PVEE, which may facilitate to reduce the quantity of wirings on the light-emitting panel 000.

In certain embodiments, referring to FIG. 1, FIGS. 9-10, and FIGS. 12-14, in the disclosed light-emitting panel 000, each light-emitting unit 20 may further include a first terminal 201D and a second terminal 201S. The second terminal 201S may be connected to the first power supply terminal 50, and the first terminal 201D may be connected to the second power supply terminal 60.

The disclosed embodiments may explain that each light-emitting unit 20 may further include a first terminal 201D and a second terminal 201S. The second terminal 201S may be connected to the first power supply terminal 50, and the first terminal 201D may be connected to the second power supply terminal 60. Optionally, the light-emitting element 202 may be located between the first terminal 201D and the second power supply terminal 60 (as shown in FIG. 13), or may be located between the second terminal 201S and the first power supply terminal 50 (as shown in FIG. 14), which may not be limited by the present disclosure. The light-emitting element 202 may merely need to be disposed between the first power supply terminal 50 and the second power supply terminal 60, such that the driving current may pass through the light-emitting element 202 when the light-emitting control unit 201 is turned on.

In certain embodiments, referring to FIG. 1, FIGS. 9-10, and FIGS. 12-14, the disclosed light-emitting panel 000 may further include a plurality of first power signal lines 70 and a plurality of second power signal lines 80. At least two first power signal lines 70 may be connected to a same first power supply terminal 50, and at least two second power signal lines 80 may be connected to a same second power supply terminal 60.

The disclosed embodiments may explain that the light-emitting panel 000 may include a plurality of first power signal lines 70 and a plurality of second power signal lines 80. The first power signal line 70 may be configured to provide the first power signal PVEE, and the second power signal line 80 may be configured to provide the second power signal PVDD. In the disclosed light-emitting panel 000, at least two first power signal lines 70 may be connected to a same first power supply terminal 50, and at least two second power signal lines 80 may be connected to a same second power supply terminal 60. Optionally, all the first power signal lines 70 may be connected together, and all the second power signal lines 80 may be connected together, which may facilitate to reduce the quantity of wirings on the light-emitting panel 000. Further, when the control circuit 40 provides the second power signal PVDD and the first power signal PVEE, a quantity of power signal output terminals in the control circuit 40 may be reduced, which may facilitate to reduce the complexity of the connection of the control circuit 40.

Optionally, the first power signal PVEE may be zero, and the second power signal PVDD may be greater than or equal to the threshold voltage of the light-emitting element 202. Because in the light-emitting process of the light-emitting element 202 driven by the duty cycle of the first pulse width modulation signal, the voltage value of the second power signal PVDD may be dependent on the threshold voltage of the light-emitting element 202, and the voltage value of the first power signal PVEE may often be zero. Therefore, the first power signal PVEE provided by the control circuit 40 to the first power supply terminal 50 of the light-emitting unit 20 may be zero, and the second power signal PVDD provided by the control circuit 40 to the second power supply terminal 60 of the light-emitting unit 20 may be greater than or equal to the threshold voltage of the light-emitting element 202, such that the control circuit 40 may provide each light-emitting unit 20 with a positive power signal and a negative power signal, to achieve the normal light-emitting operation of the light-emitting unit 20.

Figure 19:
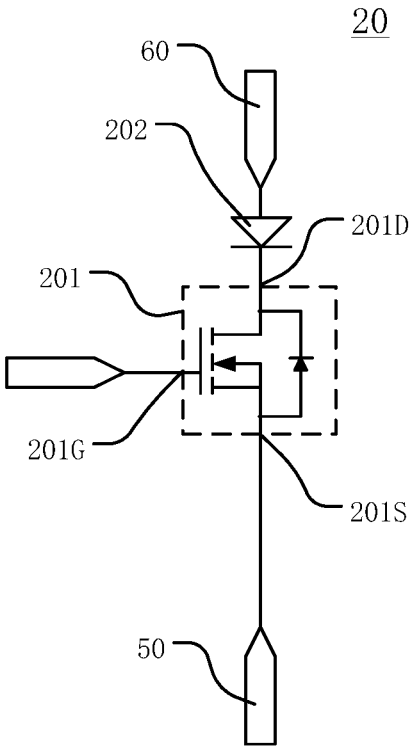
FIG. 19 illustrates a schematic diagram of a circuit connection structure of a light-emitting unit consistent with disclosed embodiments of the present disclosure.

FIG. 19 illustrates a schematic diagram of a circuit connection structure of a light-emitting unit consistent with disclosed embodiments of the present disclosure. In certain embodiments, referring to FIG. 1, FIGS. 9-10, FIGS. 12-14, and FIG. 19, the light-emitting control unit 201 may include a thin film transistor and/or a metal-oxide-semiconductor field-effect transistor. Optionally, the light-emitting control unit 201 may include a thin film transistor, and the light-emitting control unit 201 may further include a metal-oxide-semiconductor field-effect transistor (as shown in FIG. 19). The light-emitting control unit 201 may further include a combination of multiple thin film transistors connected to each other. The light-emitting control unit 201 may further include a combination of multiple metal-oxide-semiconductor field-effect transistors connected to each other. The light-emitting control unit 201 may further include a combination of thin film transistors and metal-oxide-semiconductor field-effect transistors connected to each other, which may be selected and set according to practical applications during specific implementation.

A gate of the thin film transistor and/or metal-oxide-semiconductor field-effect transistor may be the control terminal 201G of the light-emitting control unit 201. A drain of the thin film transistor and/or metal-oxide-semiconductor field-effect transistor may be the first terminal 201D of the light-emitting control unit 201. A source of the thin film transistor and/or metal-oxide-semiconductor field-effect transistor may be the second terminal 201S of the light-emitting control unit 201.

The disclosed embodiments may explain that the light-emitting control unit 201 may include a thin film transistor, and the light-emitting control unit 201 may further include a metal-oxide-semiconductor field-effect transistor. The light-emitting control unit 201 may further include a combination of multiple thin film transistors connected to each other. The light-emitting control unit 201 may further include a combination of multiple metal-oxide-semiconductor field-effect transistors connected to each other. The light-emitting control unit 201 may further include a combination of thin film transistors and metal-oxide-semiconductor field-effect transistors connected to each other.

The metal-oxide-semiconductor field-effect transistor (MOSFET) may be a field-effect transistor that is capable of being widely applied in analog and digital circuits. According to the channel polarity, the metal-oxide-semiconductor field-effect transistors may be divided into N-type with the majority of electrons in the channel and P-type with the majority of holes in the channel, which may often be referred to as N-type MOSFET (NMOSFET) and P-type MOSFET (PMOSFET). Whether the transistor is an N-type transistor or a P-type transistor may not be limited by the present disclosure. The light-emitting control unit 201 in the present disclosure may include a thin film transistor and/or a metal-oxide-semiconductor field-effect transistor. The metal-oxide-semiconductor field-effect transistor is a voltage-controlled device, which may facilitate to save power consumption.

Figure 24:
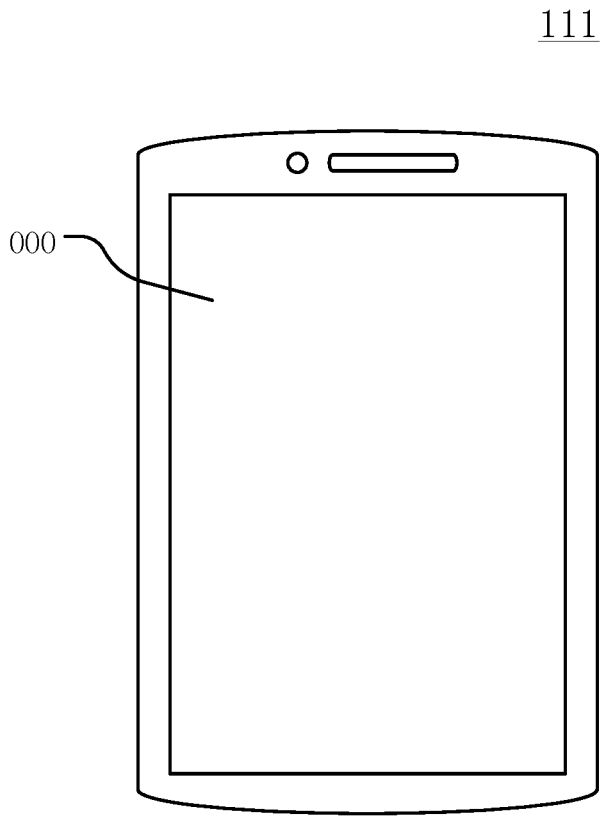
FIG. 24 illustrates a schematic diagram of an exemplary display device consistent with disclosed embodiments of the present disclosure.

The present disclosure also provides a display device. FIG. 24 illustrates a schematic diagram of a display device consistent with disclosed embodiments of the present disclosure. Referring to FIG. 24, the display device 111 may include the light-emitting panel 000 in any of the above-disclosed embodiments. The light-emitting panel 000 may be used as the backlight of the display device 111, and may also be used as the display panel of the display device 111. For illustrative purposes, the display device 111 as a mobile phone in embodiment associated with FIG. 24 may be described in detail as an example. It should be understood that the display device 111 in the present disclosure may be a computer, a TV, a vehicle-mounted display device, or any other display device with a display function, which may not be limited by the present disclosure. The display device 111 in the present disclosure may have the beneficial effects of the light-emitting panel 000 in the present disclosure, which may refer to specific descriptions of the light-emitting panel 000 in the foregoing embodiments, and may not be repeated herein.

The disclosed light-emitting panel and brightness adjustment method, and display device may have following beneficial effects. The disclosed brightness adjustment method may include following. A to-be-displayed screen of the light-emitting panel may be obtained by controlling the external control signal source of the data signal input terminal, and a different grayscale value corresponding to each light-emitting unit in the to-be-displayed screen may be determined. According to the different grayscale value, the first pulse width modulation signal and the first voltage signal corresponding to each grayscale value in the data storage unit may be called, and then may be transmitted to each light-emitting unit through the first signal terminal. Each light-emitting unit may generate light-emitting brightness corresponding to the grayscale value, to achieve the display of the displayed screen.

The brightness adjustment method in the present disclosure may simultaneously control the two factors controlling the on-period and the conduction current of the light-emitting unit. Based on the interaction effects of the first pulse width modulation signal and the first voltage signal, more kinds of brightness gradient changes may be adjusted compared with the existing adjustment method of using the pulse width modulation signal. According to the correspondence relationship between different brightness and the first pulse width modulation signal as well as the first voltage signal, the brightness interval may be divided to obtain the correspondence relationship between the different grayscale value and the first pulse width modulation signal as well as the first voltage signal. Therefore, different light-emitting unit may generate corresponding light-emitting brightness according to the requirements of different grayscale value, and, thus, may provide more kinds of different gray-scale brightness to achieve substantially fine dimming. When the light-emitting panel is used as a backlight or a display, the requirements of high-resolution backlight or display may be satisfied, which may improve the display quality.

It should be noted that in the above embodiments various components in the light-emitting panel and the display device may be arbitrarily combined without contradiction, and the brightness adjustment method and structure of the light-emitting panel and the display device obtained after the combination should fall in the protection scope of the technical solutions of the present disclosure.

The description of the disclosed embodiments is provided to illustrate the present disclosure to those skilled in the art. Various modifications to these embodiments will be readily apparent to those skilled in the art, and the generic principles defined herein may be applied to other embodiments without departing from the spirit or scope of the disclosure. Thus, the present disclosure is not intended to be limited to the embodiments illustrated herein but is to be accorded the widest scope consistent with the principles and novel features disclosed herein.

What is claimed is:

1. A brightness adjustment method of a light-emitting panel, comprising:

providing the light-emitting panel, the light-emitting panel including:

a substrate, a plurality of light-emitting units arranged in an array on the substrate, a control circuit, and a plurality of signal lines disposed on the substrate, wherein:

the control circuit includes a data signal input terminal, a data storage unit, a plurality of first signal terminals, a voltage adjustment unit, and a pulse control unit, the data storage unit is configured to store a first voltage signal and a first pulse width modulation signal corresponding to a different grayscale value, the data signal input terminal is electrically connected with the data storage unit, the data storage unit is electrically connected with the plurality of first signal terminals, and each signal line connects a light-emitting unit of the plurality of light-emitting units with a first signal terminal of the plurality of first signal terminals;

the voltage adjustment unit generates a plurality of first voltage signals, and transmits the first voltage signal of the plurality of first voltage signals to the first signal terminal;

the pulse control unit generates a plurality of first pulse width modulation signals, and transmits the first pulse width modulation signal of the plurality of first pulse width modulation signals to the first signal terminal; and the first signal terminal synchronously transmits the first voltage signal and the first pulse width modulation signal to the light-emitting unit through the signal line;

obtaining a to-be-displayed screen, and determining each grayscale value of a corresponding light-emitting unit of the plurality of light-emitting units in the to-be-displayed screen; and according to different grayscale values, calling the first pulse width modulation signal and the first voltage signal corresponding to each grayscale value in the data storage unit.

2. The brightness adjustment method according to claim 1, wherein:

the first signal terminal synchronously transmits the first voltage signal and the first pulse width modulation signal to the light-emitting unit through the signal line to perform a brightness test on the light-emitting unit of the light-emitting panel.

3. The brightness adjustment method according to claim 2, further including:

after finishing the brightness test on the light-emitting unit of the light-emitting panel, obtaining a correspondence relationship between the different grayscale value and the first voltage signal as well as the first pulse width modulation signal.

4. The brightness adjustment method according to claim 3, further including:

when a same grayscale value corresponds to multiple groups of different relationships between the first voltage signal and the first pulse width modulation signal, removing repeated groups to obtain the correspondence relationship between one grayscale value and one first voltage signal as well as one first pulse width modulation signal; and burning the correspondence relationship between the one grayscale value and the one first voltage signal as well as the one first pulse width modulation signal into the data storage unit.

5. The brightness adjustment method according to claim 2, wherein:

the control circuit further includes a filter electrically connected with the voltage adjustment unit, wherein the filter is configured to transmit a first voltage signal greater than a preset voltage among the plurality of first voltage signals generated by the voltage adjustment unit to the first signal terminal.

6. The brightness adjustment method according to claim 2, wherein:

each light-emitting unit includes a light-emitting control unit and a light-emitting element electrically connected to the light-emitting control unit, and the light-emitting control unit is configured to provide a driving current to the light-emitting element;

each signal line connects a control terminal of the light-emitting control unit in the light-emitting unit with the first signal terminal; and the light-emitting control unit further includes a first terminal and a second terminal, the second terminal is connected to a first power supply terminal, and the first terminal is connected to a second power supply terminal, wherein:

for the light-emitting unit, according to a different duty cycle of the first pulse width modulation signal provided by the pulse control unit, the light-emitting unit outputs M-level light-emitting brightness, and the duty cycle of the first pulse width modulation signal is $1/n \times 100\%$, wherein n is an even number, and M is a quantity of n and is a positive integer, simultaneously, according to a different first voltage signal provided by the voltage adjustment unit, a voltage difference between the control terminal and the second terminal of the light-emitting control unit is different, Q voltage differences between the control terminal and the second terminal of the light-emitting control unit correspond to Q currents flowing through the light-emitting element, the Q currents flowing through the light-emitting element change in a gradient, and the light-emitting unit outputs Q-level light-emitting brightness, wherein Q is a positive integer, and a quantity of change gradients of light-emitting brightness generated by the light-emitting unit is W, wherein $W \leq M \times Q$, and W is a positive integer.

7. The brightness adjustment method according to claim 6, wherein:

according to the different first voltage signal provided by the voltage adjustment unit, the voltage difference between the control terminal and the second terminal of the light-emitting control unit is different, Q voltage differences between the control terminal and the second terminal of the light-emitting control unit correspond to Q currents flowing through the light-emitting element, the Q currents flowing through the light-emitting element change in a gradient, and the light-emitting unit outputs Q-level luminous brightness, wherein the correspondence relationship includes:

Vgs=f(G), wherein Vgs is the voltage difference between the control terminal and the second terminal of the light-emitting control unit, G is a light-emitting gray scale of the light-emitting element corresponding to the current flowing through the light-emitting element, and f is a gamma curve function, and $I_D$=g(f(G)), wherein $I_D$ is the current flowing through the light-emitting element, and g is a relationship function between the voltage difference between the control terminal and the second terminal of the light-emitting control unit and the current of the light-emitting element.

8. The brightness adjustment method according to claim 1, wherein:

the control circuit is integrated into a first chip, wherein:

the first chip is configured to generate the first voltage signal according to a relationship between the gray scale and a voltage, and the first voltage signal is a pulse signal, and the first chip is configured to generate the first pulse width modulation signal according to a relationship between the gray scale and a pulse width.

9. The brightness adjustment method according to claim 1, wherein:

for the light-emitting panel, within a period of displaying one frame of a displayed screen, first voltage signals applied to signal lines of the plurality of signal lines that are correspondingly connected to two adjacent light-emitting units of the plurality of light-emitting units have opposite polarities, such that within the period of displaying one frame of the displayed screen, the light-emitting units in adjacent two rows are alternately displayed.

10. The brightness adjustment method according to claim 1, wherein:

a refresh frequency of the light-emitting panel is greater than or equal to 120 Hz.

11. A light-emitting panel, comprising:

a substrate, a plurality of light-emitting units arranged in an array on the substrate, a control circuit, and a plurality of signal lines disposed on the substrate, wherein:

the control circuit includes a data signal input terminal, a data storage unit, and a plurality of first signal terminals, the data storage unit is configured to store a first voltage signal and a first pulse width modulation signal corresponding to a different grayscale value, the data signal input terminal is electrically connected with the data storage unit, the data storage unit is electrically connected with the plurality of first signal terminals, and each signal line connects a light-emitting unit of the plurality of light-emitting units with a first signal terminal of the plurality of first signal terminals, in a light-emitting stage, the data storage unit provides different first pulse width modulation signals and different first voltage signals to the first signal terminal, each light-emitting unit includes a first grayscale value and a second grayscale value different from the first grayscale value, the first grayscale value corresponds to a first pulse signal outputted from the first signal terminal, and the second grayscale value corresponds to a second pulse signal outputted from the first signal terminal, wherein the first pulse signal and the second pulse signal have different amplitudes, and/or the first pulse signal and the second pulse signal have different pulse widths, and in the light-emitting stage, each light-emitting unit further includes a third grayscale value, wherein:

the third grayscale value has a value between the first grayscale value and the second grayscale value, the third grayscale value corresponds to a third pulse signal outputted from the first signal terminal, and the third pulse signal and the second pulse signal have different amplitudes, and/or the third pulse signal and the second pulse signal have different pulse width.

12. The light-emitting panel according to claim 11, wherein:

each light-emitting unit includes a light-emitting control unit and a light-emitting element electrically connected to the light-emitting control unit, wherein the light-emitting control unit is configured to provide a driving current to the light-emitting element; and each signal line connects a control terminal of the light-emitting control unit in the light-emitting unit with the first signal terminal.

13. The light-emitting panel according to claim 12, wherein:

each light-emitting unit further includes a first power supply terminal and a second power supply terminal electrically connected to the first power supply terminal, wherein the first power supply terminal provides a first power signal for the light-emitting unit, and the second power supply terminal provides a second power signal for the light-emitting unit.

14. The light-emitting panel according to claim 13, wherein:

the first power signal is zero, and the second power signal is greater than or equal to a threshold voltage of the light-emitting element.

15. The light-emitting panel according to claim 13, wherein:

the light-emitting control unit further includes a first terminal and a second terminal, wherein the second terminal is connected to the first power supply terminal, and the first terminal is connected to the second power supply terminal.

16. The light-emitting panel according to claim 15, wherein:

the light-emitting control unit includes a thin film transistor and/or a metal-oxide-semiconductor field-effect transistor, wherein:

a gate of the thin film transistor and/or the metal-oxide-semiconductor field-effect transistor is the control terminal of the light-emitting control unit, a drain of the thin film transistor and/or the metal-oxide-semiconductor field-effect transistor is the first terminal of the light-emitting control unit, and a source of the thin film transistor and/or the metal-oxide-semiconductor field-effect transistor is the second terminal of the light-emitting control unit.

17. The light-emitting panel according to claim 13, further including:

a plurality of first power signal lines and a plurality of second power signal lines, wherein at least two of the plurality of first power signal lines are connected to the same first power supply terminal, and at least two of the plurality of second power signal lines are connected to the same second power supply terminal.

18. The light-emitting panel according to claim 11, wherein:

within a period of displaying one frame of a displayed screen, first voltage signals applied to signal lines of the plurality of signal lines that are correspondingly connected to two adjacent light-emitting units of the plurality of light-emitting units have opposite polarities, such that within the period of displaying one frame of the displayed screen, the light-emitting units in adjacent two rows are alternately displayed.

19. The light-emitting panel according to claim 11, wherein:

a refresh frequency of the light-emitting panel is greater than or equal to 120 Hz.

20. A display device, comprising:

a light-emitting panel, wherein the light-emitting panel includes:

a substrate, a plurality of light-emitting units arranged in an array on the substrate, a control circuit, and a plurality of signal lines disposed on the substrate, wherein:

the control circuit includes a data signal input terminal, a data storage unit, and a plurality of first signal terminals, the data storage unit is configured to store a first voltage signal and a first pulse width modulation signal corresponding to a different grayscale value, the data signal input terminal is electrically connected with the data storage unit, the data storage unit is electrically connected with the plurality of first signal terminals, and each signal line connects a light-emitting unit of the plurality of light-emitting units with a first signal terminal of the plurality of first signal terminals, in a light-emitting stage, the data storage unit provides different first pulse width modulation signals and different first voltage signals to the first signal terminal, each light-emitting unit includes a first grayscale value and a second grayscale value different from the first grayscale value, the first grayscale value corresponds to a first pulse signal outputted from the first signal terminal, and the second grayscale value corresponds to a second pulse signal outputted from the first signal terminal, wherein the first pulse signal and the second pulse signal have different amplitudes, and/or the first pulse signal and the second pulse signal have different pulse widths, and in the light-emitting stage, each light-emitting unit further includes a third grayscale value, wherein:

the third grayscale value has a value between the first grayscale value and the second grayscale value, the third grayscale value corresponds to a third pulse signal outputted from the first signal terminal, and the third pulse signal and the second pulse signal have different amplitudes, and/or the third pulse signal and the second pulse signal have different pulse width.

* * * * *